US007882659B2

(12) United States Patent
Gyory et al.

(10) Patent No.: US 7,882,659 B2
(45) Date of Patent: Feb. 8, 2011

(54) MODULAR ASSEMBLY

(75) Inventors: Janos B. Gyory, Miami, FL (US); Istvan Gyory, Port St. Lucie, FL (US)

(73) Assignee: Modular Container Solutions LLC, Miami, FL (US)

( * ) Notice: Subject to any disclaimer, the term of this patent is extended or adjusted under 35 U.S.C. 154(b) by 0 days.

(21) Appl. No.: 12/148,914

(22) Filed: Apr. 23, 2008

(65) Prior Publication Data

US 2009/0266006 A1 Oct. 29, 2009

(51) Int. Cl.

| | |
|---|---|
| ***E04B 1/346*** | (2006.01) |
| ***E04H 1/00*** | (2006.01) |
| ***E05C 7/06*** | (2006.01) |
| ***B62D 33/00*** | (2006.01) |
| ***A63G 1/00*** | (2006.01) |

(52) U.S. Cl. ..... 52/79.5; 52/64; 52/66; 52/79.1; 49/104; 49/109; 296/182.1; 296/183.1; 472/3

(58) Field of Classification Search ..... 52/66, 52/64, 79.1, 268, 269, 270, 284, 309.11, 52/79.5; 49/104, 109, 106, 116; 296/182.1, 296/183.1; 472/3

See application file for complete search history.

(56) References Cited

U.S. PATENT DOCUMENTS

| | | | | |
|---|---|---|---|---|
| 4,534,141 | A * | 8/1985 | Fagnoni | 52/68 |
| 4,635,412 | A * | 1/1987 | Le Poittevin | 52/79.5 |
| 4,660,332 | A * | 4/1987 | Colvin, Jr. | 52/79.5 |
| 4,891,919 | A * | 1/1990 | Palibroda | 52/79.5 |
| 4,912,891 | A | 4/1990 | Bertrand | |
| 5,152,109 | A | 10/1992 | Boers | |
| 5,185,973 | A | 2/1993 | Oldani | |
| 5,237,784 | A | 8/1993 | Ros | |
| 5,345,730 | A | 9/1994 | Jurgensen | |
| 5,761,854 | A | 6/1998 | Johnson et al. | |
| 5,966,956 | A * | 10/1999 | Morris et al. | 62/259.1 |
| 6,003,919 | A | 12/1999 | Shook | |
| 6,223,479 | B1 * | 5/2001 | Stockli | 52/68 |
| 6,253,498 | B1 | 7/2001 | Fanucci | |
| 6,345,471 | B1 | 2/2002 | Gyllenhammar | |

(Continued)

FOREIGN PATENT DOCUMENTS

| | | |
|---|---|---|
| JP | 9-032325 A | 2/1997 |

(Continued)

*Primary Examiner*—Brian E Glessner
*Assistant Examiner*—Omar Hijaz
(74) *Attorney, Agent, or Firm*—Sughrue Mion, PLLC

(57) ABSTRACT

A modular assembly structured to assume either a shipping container configuration or a building unit configuration including a frame comprising a plurality of support members and defining both a part of the building unit configuration and shipping unit configuration. A plurality of frame panels are movably connected to the frame and disposable in either a closed position or an opened position so as to respectively and at least partially define either the shipping unit configuration or the building unit configuration. The plurality of unit panels are movably connected to the frame and disposable outwardly therefrom to collectively define end wall portions and ceiling portions of the building unit configuration wherein the unit panels may be stored within the interior of the frame. An erection assembly is selectively disposable in an assembled position exteriorly of the frame and supported thereon so as to facilitate the assembly of at least some of the frame panels and/or unit panels.

31 Claims, 21 Drawing Sheets

U.S. PATENT DOCUMENTS

| | | | | |
|---|---|---|---|---|
| 6,658,799 | B1 | 12/2003 | Stoodley | |
| 6,712,414 | B2 | 3/2004 | Morrow | |
| 6,772,563 | B2 | 8/2004 | Kuhn | |
| 6,983,567 | B2 * | 1/2006 | Ciotti | 52/79.5 |
| 7,117,645 | B2 | 10/2006 | Bzorgi | |
| 7,418,802 | B2 | 9/2008 | Sarine et al. | |
| 7,631,460 | B2 | 12/2009 | Napier | |
| 7,647,731 | B2 | 1/2010 | Muir | |
| 7,658,037 | B2 | 2/2010 | Bucher et al. | |
| 7,794,001 | B2 | 9/2010 | Blackwell et al. | |
| 2006/0070306 | A1 | 4/2006 | Lin | |
| 2006/0201072 | A1 | 9/2006 | Gibson | |
| 2006/0225369 | A1 * | 10/2006 | Napier | 52/69 |
| 2007/0113488 | A1 | 5/2007 | Wilson | |
| 2007/0245637 | A1 | 10/2007 | Czyznikiewicz | |
| 2009/0217600 | A1 | 9/2009 | De Azambuja | |
| 2009/0229194 | A1 | 9/2009 | Armillas | |
| 2010/0024314 | A1 | 2/2010 | Pope | |
| 2010/0024315 | A1 | 2/2010 | Pope | |
| 2010/0024317 | A1 | 2/2010 | Pope | |
| 2010/0050540 | A1 | 3/2010 | Bucher et al. | |
| 2010/0064599 | A1 | 3/2010 | Yang et al. | |
| 2010/0064600 | A1 | 3/2010 | Napier | |

FOREIGN PATENT DOCUMENTS

| | | | |
|---|---|---|---|
| JP | 2004-084310 | A | 3/2004 |
| KR | 2003-0008723 | A | 1/2003 |

* cited by examiner

MODULAR ASSEMBLY

BACKGROUND OF THE INVENTION

1. Field of the Invention

This invention relates to a modular assembly capable of converting from a shipping container into a building unit with utility connections, and from a building unit into a shipping container. From the shipping container configuration, a plurality of frame and unit panels are selectively positioned to form the floor, walls, and ceiling of the building unit configuration thereby forming a living and/or commercial structure complete with electrical, water and sewage connections. The building unit can then also be folded and converted into the shipping container configuration for transport to and from various sites.

2. Description of the Related Art

Building units are an essential part of everyday life. Houses come in all shapes and sizes, and can be made in various ways from various types of materials. Traditionally, building units are constructed from the ground up in a specific location, for that location. These types of building structures can take weeks or months to construct, requiring many different types of materials and construction phases to complete. Once complete, the building structure remains at its specific location as a then permanent fixture of the landscape.

Recent developments in materials and structural engineering have allowed home builders to construct "mobile" homes: pre-fabricated, full-sized housing structures that can be transported to a specific location. These mobile homes are assembled in substantial part before being delivered to the specific location. Mobile home transportation requires a "wide-load" configuration involving tractor-trailers as well as lead and follow vehicles. Once at the home site, the mobile home must be furnished and connected to local utilities, such as electrical, water and waste removal systems. The mobile home, once delivered to a specific location, becomes a permanent fixture of the landscape. The advantage to pre-fabricated housing structures lies in the ease of construction. Mobile homes are not constructed at a specific location over weeks or months, but are constructed in a factory, and simply shipped to the specific location. The disadvantages include complex and tenuous transportation.

Portable building units have been around for decades. Lightweight, easily transportable structures provide temporary shelter from the outdoor environment. However, natural disasters and other catastrophes can destroy dwellings, thereby creating a need for fully equipped emergency shelters. These emergency shelters need be easily transported and easily set up in matter of hours. The disadvantages thus far to portable, foldable building units have been numerous: difficult to transport folded configurations; multiple loose panels, multiple unit sections, and difficult hinging and fastening mechanisms; difficult to assemble panels and elements; and a lack of utilities inside the unit. Many recent attempts at portable, foldable building units have led only to exterior structures; once unfolded, the building unit provides a shell dwelling with none of the necessary amenities most homes require. Previous attempts at portable building units have also afforded hard-to-assemble structures that require special tools and sectional construction . . . .

Accordingly, there is a need in the portable building units industry for a modular assembly capable of convenient transport, and ready for easy assembly by as little as one person with no special tools or equipment, and fully equipped with utilities necessary to properly, and immediately, house occupants. The building unit need be large enough to occupy as a dwelling, yet compact and portable enough to be transported to and set up on many different locations. The building unit also need be equipped with utility connections to immediately take advantage of water, sewer, and electrical utilities.

SUMMARY OF THE INVENTION

The present invention relates to a modular assembly, which may be selectively disposed and oriented into either a shipping container configuration or a building unit configuration. From the shipping container configuration, a plurality of unit panels that form the building unit floor, walls, and ceiling are unfolded and fastened together. The building unit configuration is also complete with electrical, water and sewage connections. From the building unit configuration, the unit can be then folded and converted into a shipping container configuration for transport by a variety of appropriate transportation means. Moreover, the modular assembly of the present invention can be stored and/or transported when in the shipping container configuration. In the various preferred embodiments of the modular assembly, both the shipping container and the building unit configurations comprise a frame at least partially defined by a plurality of support members that form a box-like or other appropriately shape. The support members preferably comprise elongated, relatively high strength material members preferably, but not exclusively, in the form of steel rectangular tubes welded together to collectively comprise the stable, rigid frame.

Once the modular assembly is located at a construction or assembly site, it is ready for disposition into the building unit configuration. Accordingly, the modular assembly of the present invention includes a plurality of frame panels as well as a plurality of unit panels each at least initially disposed in a closed orientation on or within the box-like frame. In at least one preferred embodiment the frame panels and unit panels are formed from a load-bearing material such as corrugated steel or other appropriate material.

In order to facilitate the disposition of the modular assembly into either the building unit configuration or the shipping unit configuration an erection assembly is provided and selectively disposed in either a stored position or an operative position. The erection assembly comprises a plurality of erection members removable from their stored location within the frame and disposed exteriorly on the various portions of the frame. The erection assembly may also include a pulley and cable assembly cooperatively connected to the plurality of erection members, when in the operative position, to facilitate the positioning of the frame and or unit panels in either their closed or opened positions.

The plurality of frame panels include at least one but preferably two side panels each of which may define the "long sides" of the frame when in the shipping container configuration. These frame panels, may also define the long sidewall portions of the building unit configuration when so assembled. Accordingly, the one or more frame panels are pivotally or hingedly attached at their lower most longitudinal end to the frame and are selectively positioned or pivoted outwardly therefrom. When in the intended operative position, they define the floor portions of the building unit configuration. Further, each of the side panels include panel segments initially disposed in overlying confronting relation to respective ones of the frame panels. The panel segments of corresponding ones of the frame panels or side panels are hingedly or pivotally attached so as to extend outwardly from the corresponding frame panels into a substantially upright position. As such each of the combined or directly associated frame panels and panel segments collectively define a corresponding floor portion and long sidewall portion of the building unit configuration.

In addition to the above, the modular assembly further comprises a plurality of unit panels at least some of which are movably connected to the frame and initially disposed on the interior thereof when the modular assembly is in the shipping container configuration. The first set or plurality of unit panels extend outwardly and upwardly into a position which overlies the floor portion, defined by the aforementioned frame panels. The outer longitudinal edge of these unit panels are connected to or supported by corresponding longitudinal edge or portion of the now upright panel segments.

Additional ones of the plurality of unit panels may also be movably connected to the frame and are at least initially disposed on the interior thereof when the modular assembly is in the shipping container configuration. In at least one preferred embodiment these additional ones of the unit panels may be pivotally or hingedly connected along a longitudinal edge or side thereof and may extend outwardly so as to respectively define front wall portions and rear wall portions of the building unit configuration. Dependent on the overall dimensions and configuration of the building unit configuration the location and relative dimensions of the "long sidewalls" and front and rear "end walls" may vary.

The modular assembly further comprises at least one interior partition that is preferably in a fixed position within the frame when the unit arrives on site. An additional partition can be added, by way of example only, by installing an included partition panel assembly in order to define the interior "rooms" or space within the building unit configuration. The partition panel system can be unfolded and secured to the floor, to the interior of the building unit side wall, and to the at least one fixed partition, as set forth above.

In addition, cabinets can be positioned in the kitchen area using tracks installed on the kitchen walls. A water heater can be installed using pre-existing utility pipes in the modular assembly. Kitchen appliances and restroom fixtures such as sinks, toilets, oven and stove units, and refrigerators can be installed into the building unit during assembly. The building unit arrives on site equipped with both interior and exterior connections for water, sewer, and electrical utilities. Further, doors and windows can be installed into the frame and one or more of the frame or unit panels. Also, one or more doors may be pre-installed into the front or other portions of the modular assembly and windows may also be installed in appropriate locations.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
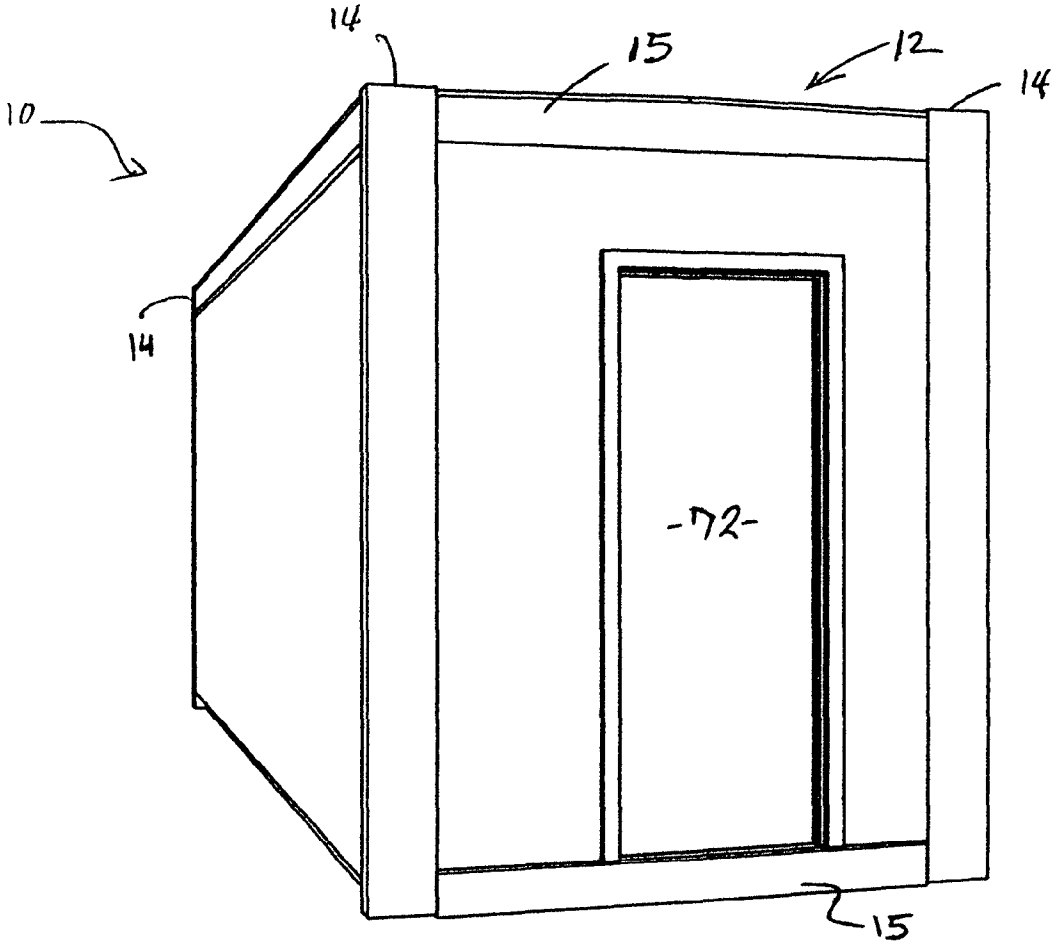
FIG. 1 is a perspective view of one preferred embodiment of the modular assembly in a shipping container configuration.

It is to be understood at the outset that the present invention is susceptible of embodiment in different forms. Of course, there is shown in the drawings and will be described in detail herein at least one specific embodiment, with the understanding that the present disclosure is to be considered as an exemplification of the principles of the invention and is not intended to limit the invention to the embodiment or embodiments illustrated.

As shown in the accompanying FIGS. 1 through 14, the modular assembly of the present invention is generally indicated as 10 and is structured to assume either a shipping unit configuration as represented in FIG. 1 or an assembled building unit configuration as represented in FIGS. 10-14. When in the building unit configuration, the modular assembly 10 can be used either as a living unit, commercial unit, or other facilities, wherein one or more individuals can occupy the modular assembly 10 and perform any of a variety of different functions.

Accordingly, the modular assembly 10 includes a frame generally indicated as 12 including a plurality of at least four support members 14 interconnected by cross braces or like additional support structures 15. The support members 14 as well as the cross braces 15 may be made of a high strength material such as, but not limited to, tubular steel or other appropriate materials welded or otherwise interconnected to one another to form a box-like configuration as represented throughout the various Figures.

Figure 1A:
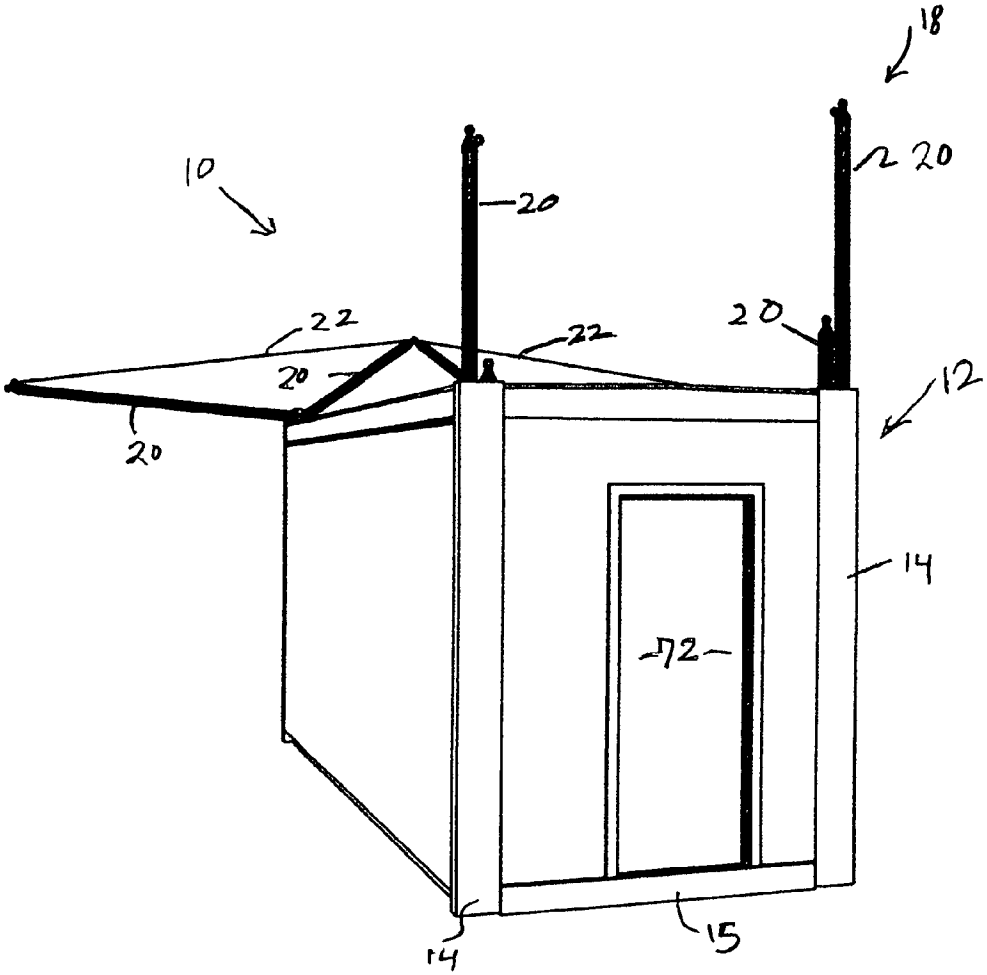
FIG. 1A is a perspective view of the embodiment of FIG. 1 in a successive step of assembly from the shipping container configuration to a building unit configuration
Figure 2:
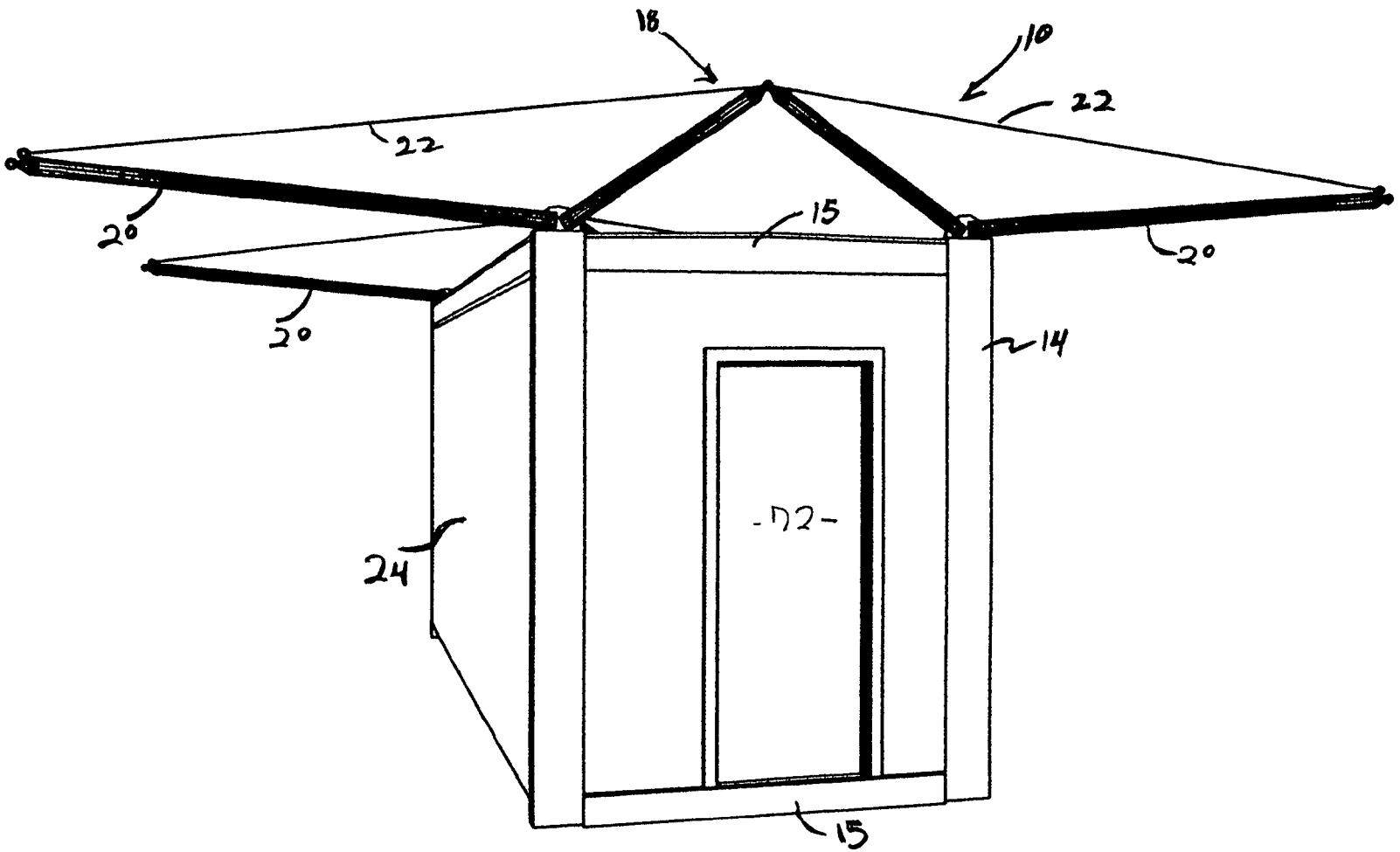
FIG. 2 is a perspective view of the embodiment of FIGS. 1 and 1A in yet another successive phase of assembly into the building unit configuration.
Figure 3:
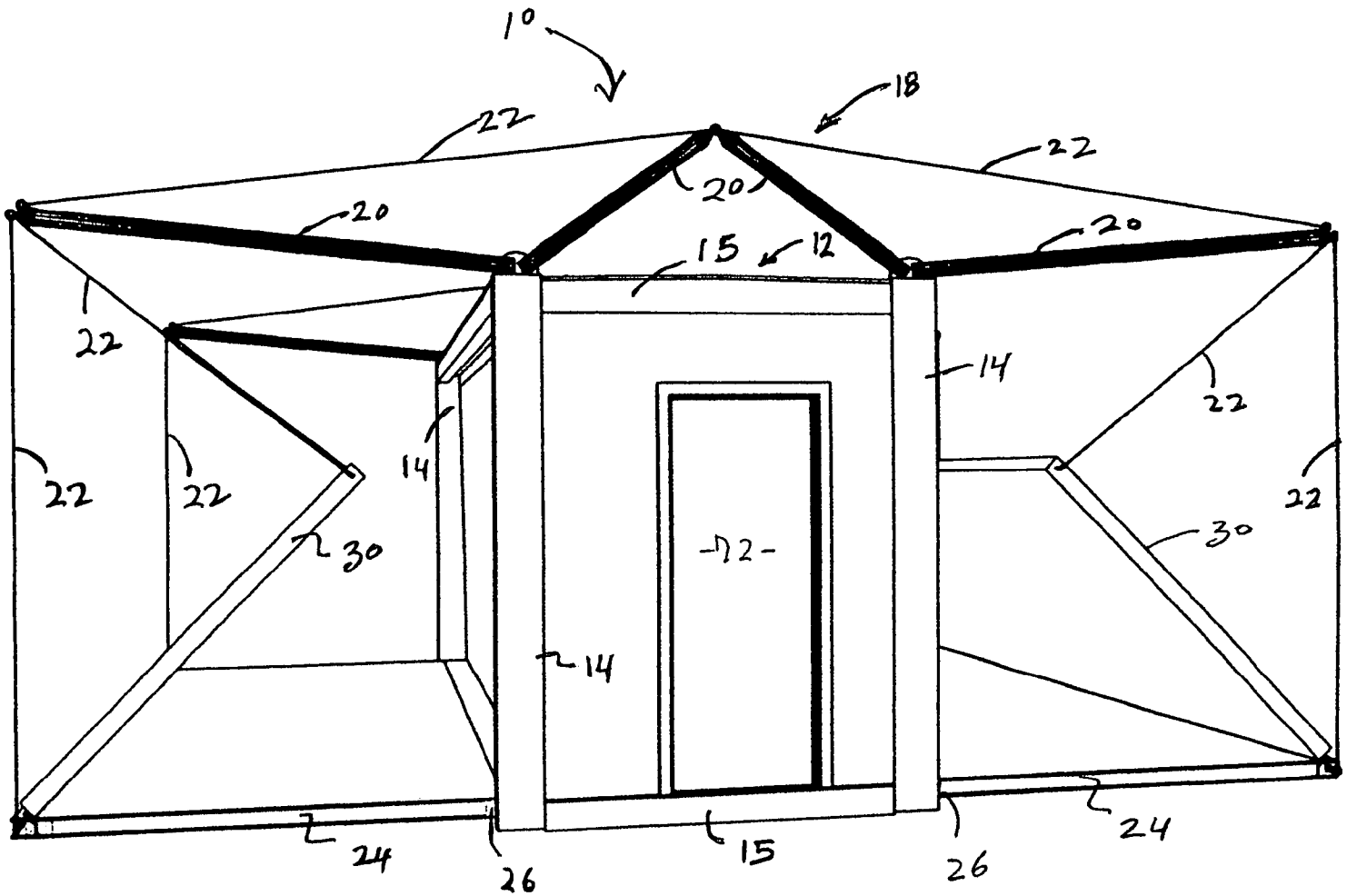
FIG. 3 is a perspective view of the embodiment of FIGS. 1 through 2 in yet another successive phase of assembly into the building unit configuration.

As will be explained in greater detail hereinafter, the modular assembly includes a plurality of frame panels and a plurality of unit panels movably connected to the frame 12 and/or to one another and selectively positionable into a closed position, as represented in FIGS. 1, 1A and 2, or an opened position as represented in FIGS. 5 through 14. The structural and operative details of both the frame panels and the unit panels will be more fully described. However, in order to properly position at least the frame panels, and possibly at least some of the plurality of unit panels, the modular assembly of the present invention also includes an erection assembly generally indicated as 18. The erection assembly 18 includes a plurality of removably interconnected erection or boom members 20 supported exteriorly on the frame 12 and extending outwardly there from, when the erection assembly 18 is in an operative or assembled position, as represented in FIGS. 2 through 9. In addition, the erection assembly 18 includes a cable and pulley assembly, wherein a plurality of pulleys or other structures serve to support, position and allow movement of a plurality of cables 22. The cables 22 may be removably connected to selected ones of the frame panels and/or unit panels in order to position them in an opened or closed position, so as to define either the building unit configuration or the shipping unit configuration. With primary reference to FIG. 1A, the plurality of erection members 20 may also be disposed in a stored position when not in use. More specifically, the stored position is preferably located within the frame 12 and more preferably in the corner portions or areas 14 of the frame 12 as represented.

Figure 4:
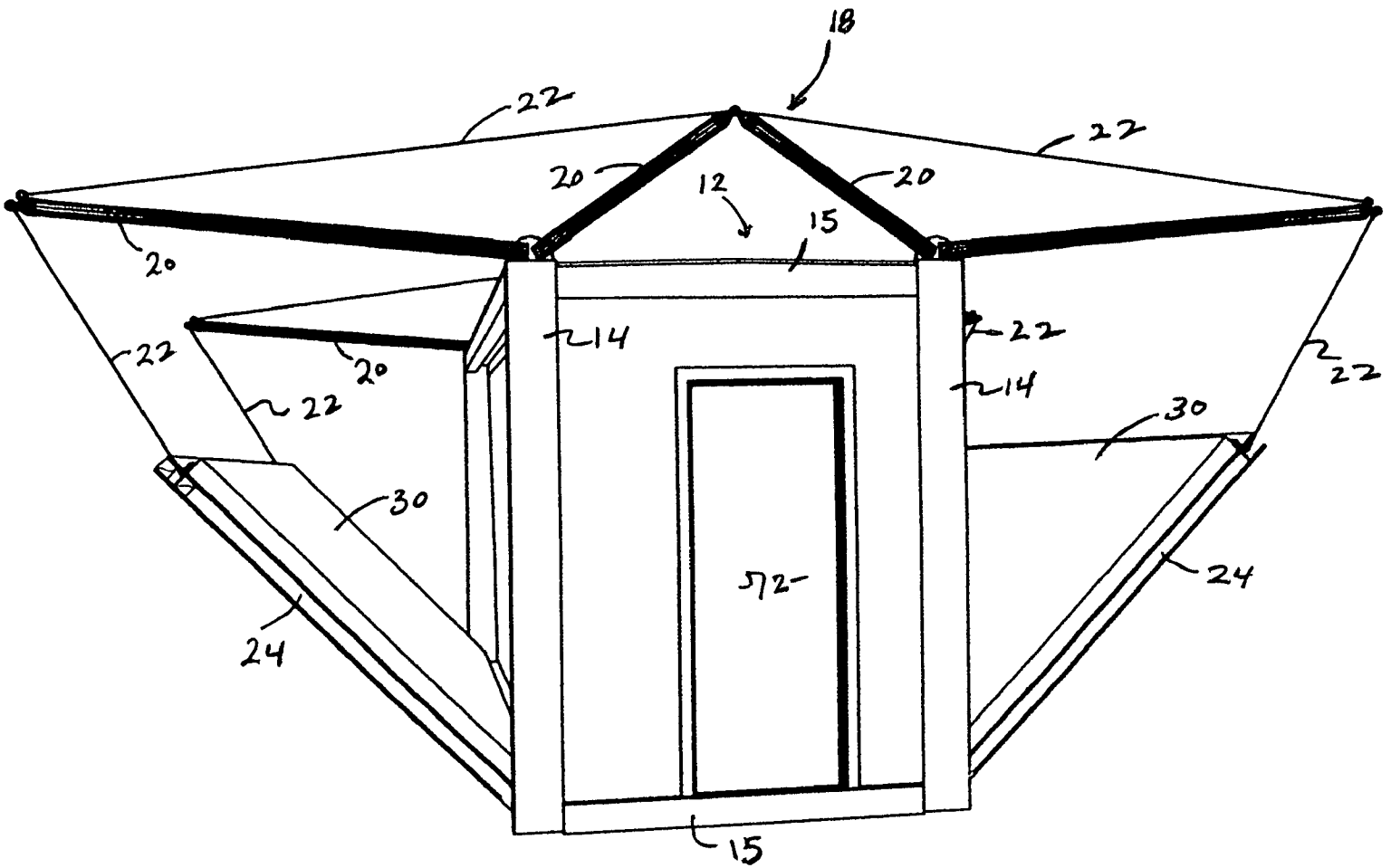
FIG. 4 is a perspective view of the embodiment of FIGS. 1 through 3 in yet another successive phase of assembly into the building unit configuration.

As set forth above, at least one but preferably a plurality of frame panels 24 are pivotally or hingedly connected at their lower most longitudinal ends to a corresponding portion of the frame 12, as at 26. The aforementioned erection assembly 18, including appropriately positioned erection members 20, may utilize the aforementioned pulley and cable 22 to lower or unfold the plurality of frame panels 24 into the opened position. The fully opened position of the frame panels 24 is represented in FIG. 4, such that each of the frame panels 24 are disposed to define the floor portions of the building unit configuration of the modular assembly 10. Also, a hinge assembly may be located at the lower portion 26 of the frame panels 26 and be structured to facilitate an appropriate "leveling" of the frame panels 24 into the "floor defining" position.

Figure 5:
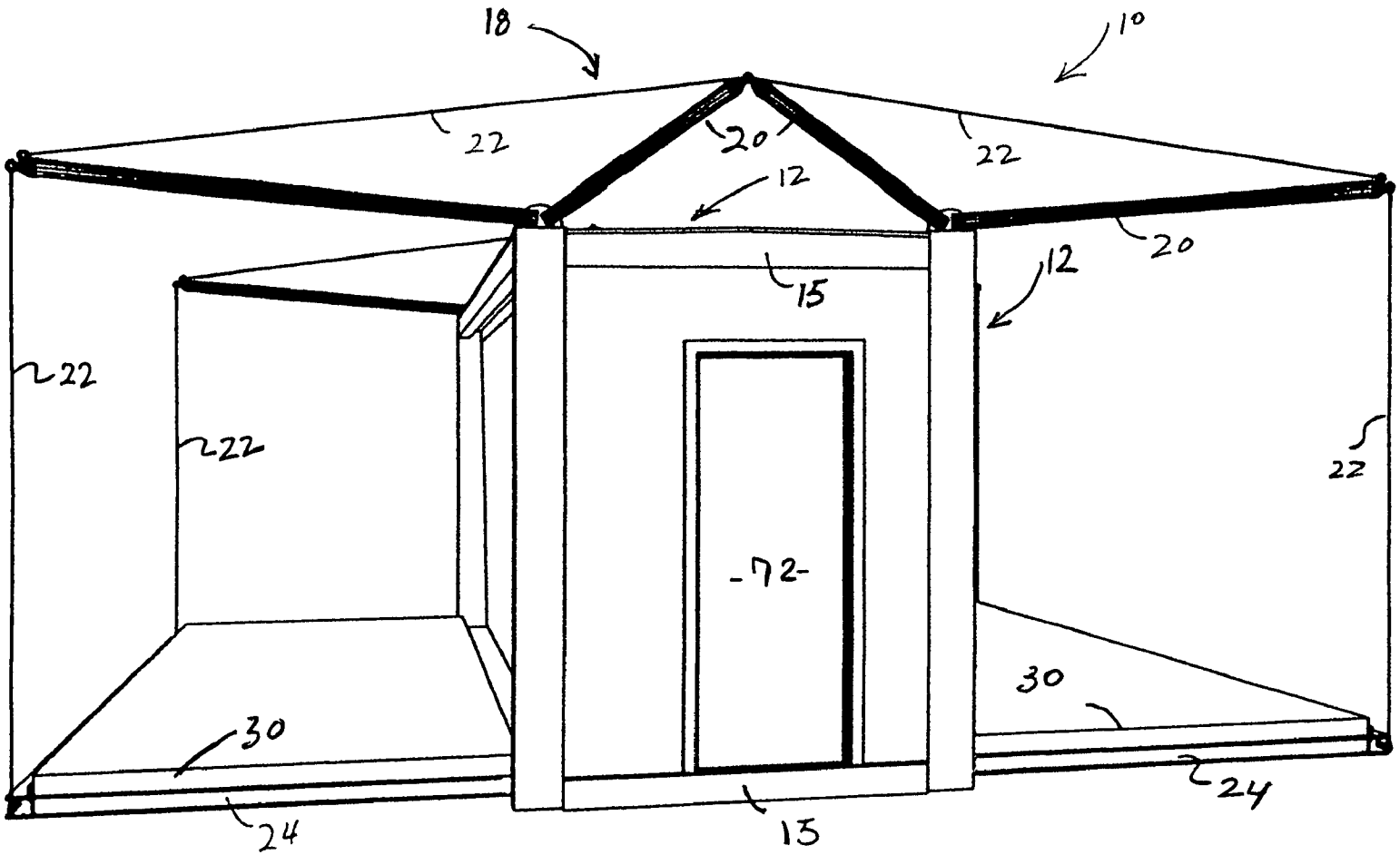
FIG. 5 is a perspective view of the embodiment of FIGS. 1 through 4 in yet another successive phase of assembly into the building unit configuration.
Figure 6:
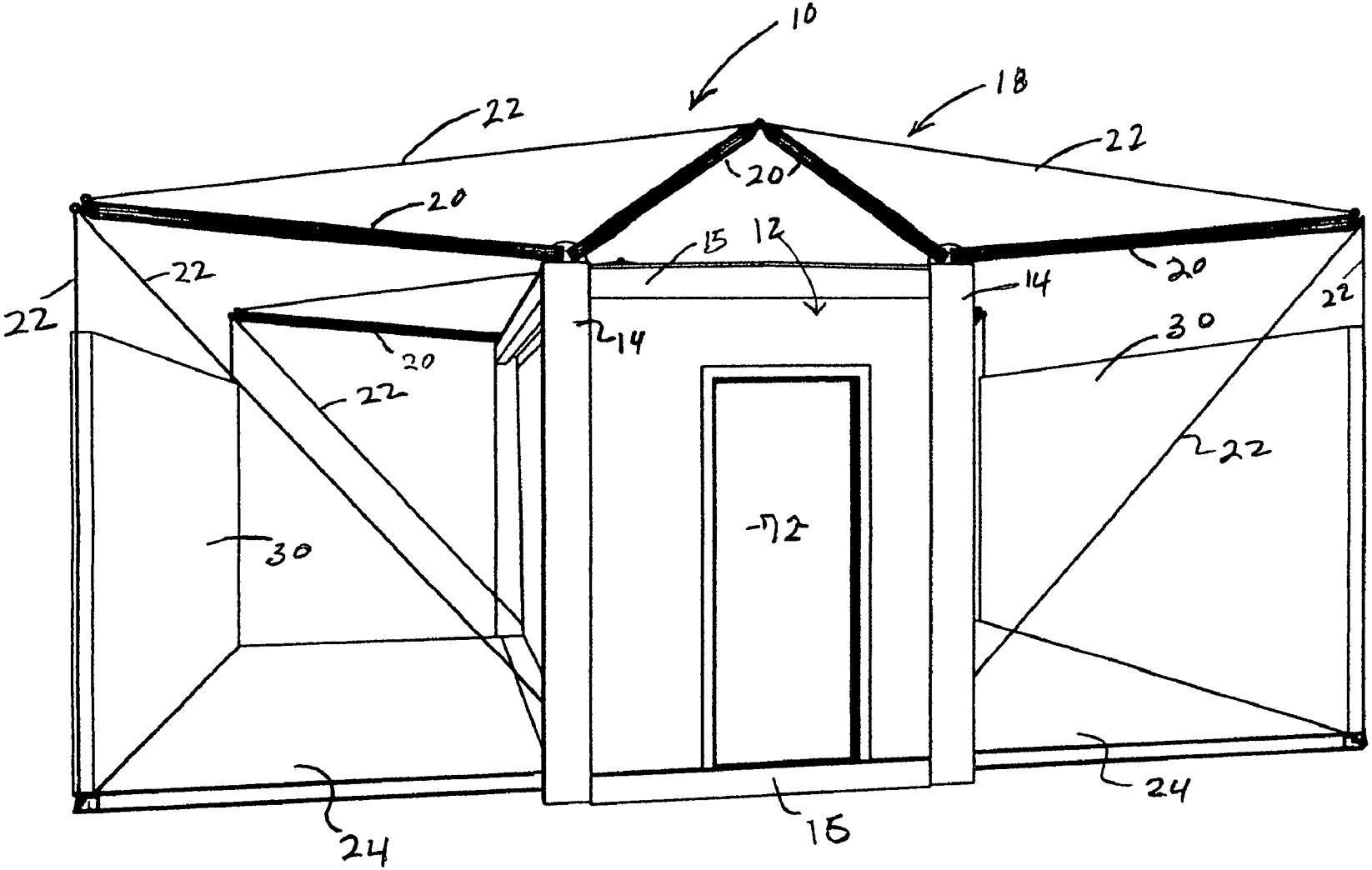
FIG. 6 is a perspective view of the embodiment of FIGS. 1 through 5 in yet another successive phase of assembly into the building unit configuration.
Figure 10:
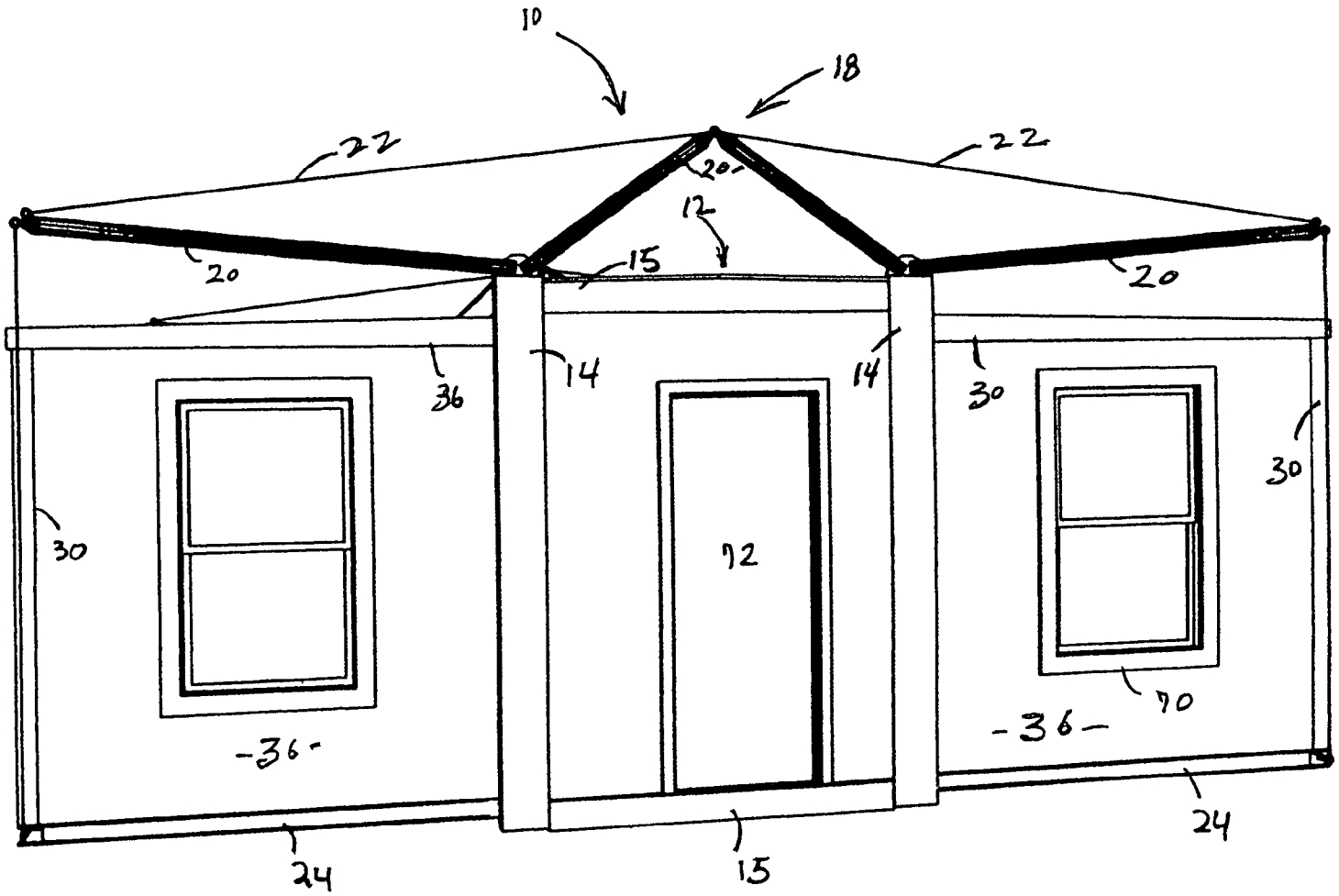
FIG. 10 is a perspective view of the outside of the front of the modular assembly when in the building unit configuration.
Figure 11:
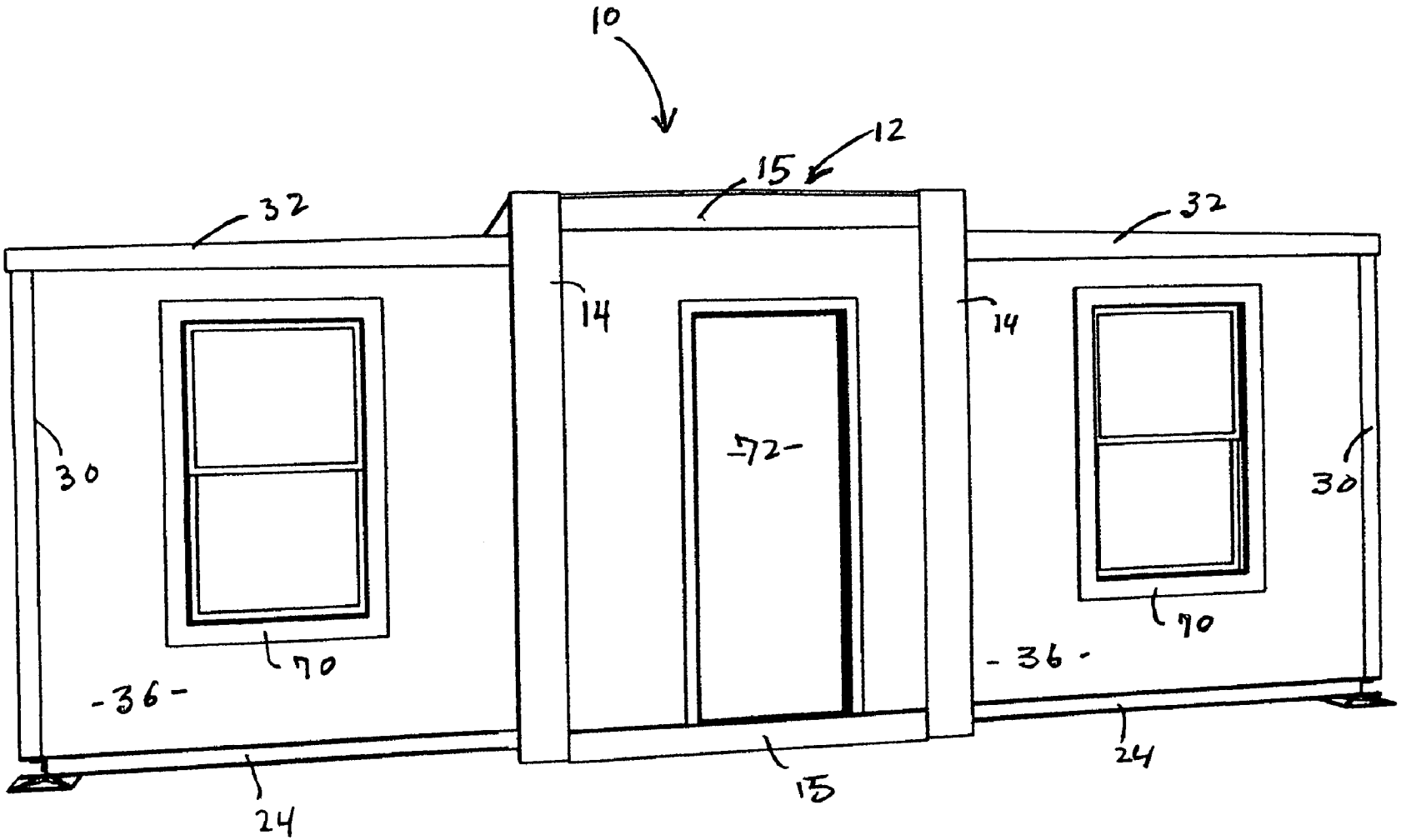
FIG. 11 is a perspective view of the assembled embodiment of FIG. 10 absent the erection assembly utilized to facilitate assembly into the building unit configuration.
Figure 12:
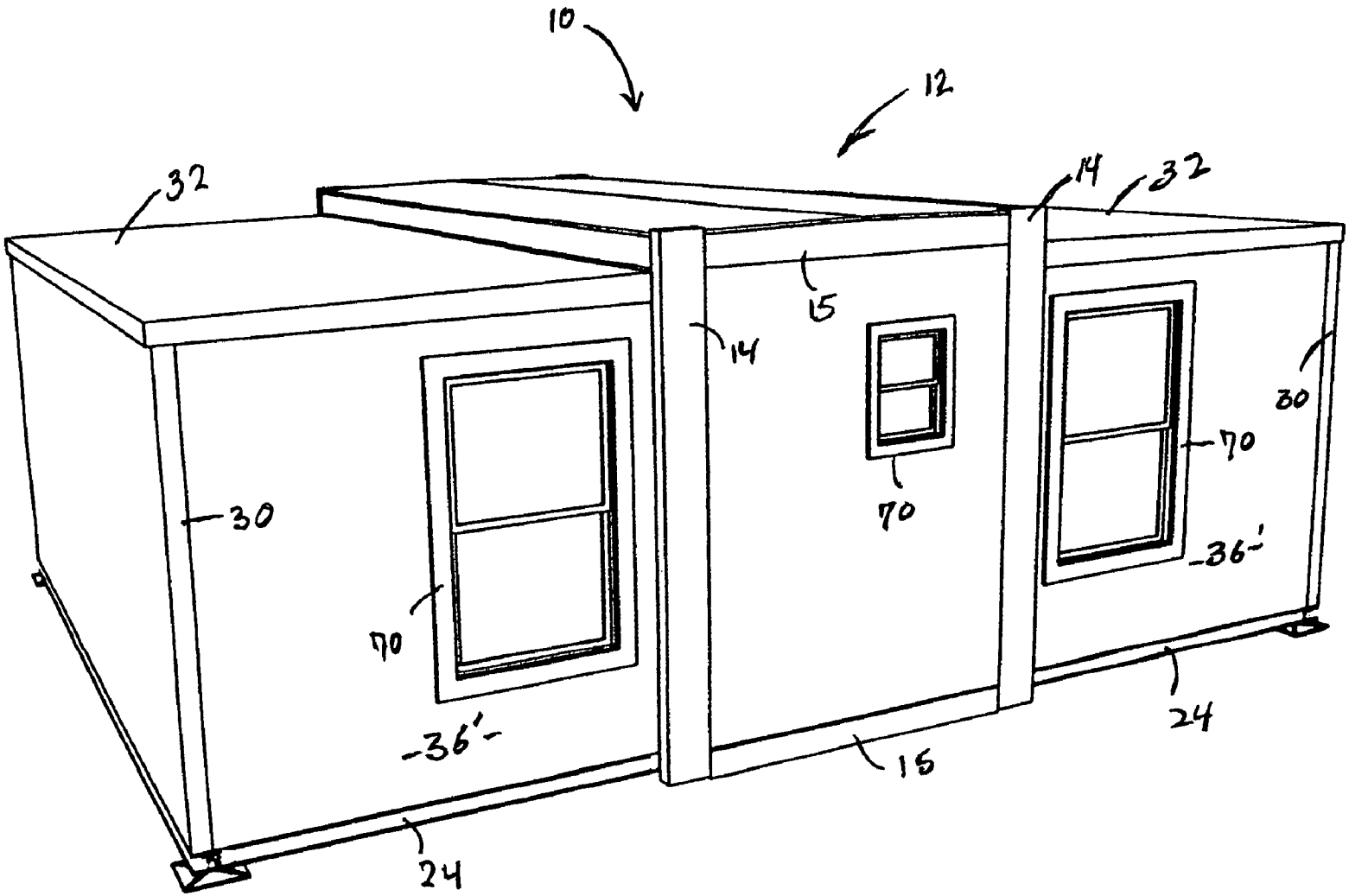
FIG. 12 is a rear perspective view of the embodiment of FIG. 11.

In addition, each of the frame panels 24 includes a panel segment 30 associated therewith. The panel segments 30, as clearly represented in FIGS. 4 and 5, are hingedly or pivotally connected at their outer most end 32 to the corresponding longitudinal edge of the frame panels 24. These panel segments 30 are unfolded into their opened position so as to be substantially vertically oriented and thereby transversely oriented relative to their corresponding frame panel 24, which now define the floor portion of the building unit configuration. As with the selective positioning of the frame panels 24, the panel segments 30 may be disposed in their completely opened position as represented in FIG. 6 through operation of the erection assembly 18 and the supporting cable(s) 22 associated therewith. Accordingly, when the panel segments 30 are in their fully opened position and vertically oriented, they may define sidewalls or more preferably the long sidewalls of the building unit configuration as also indicated in FIGS. 10-12.

Figure 7:
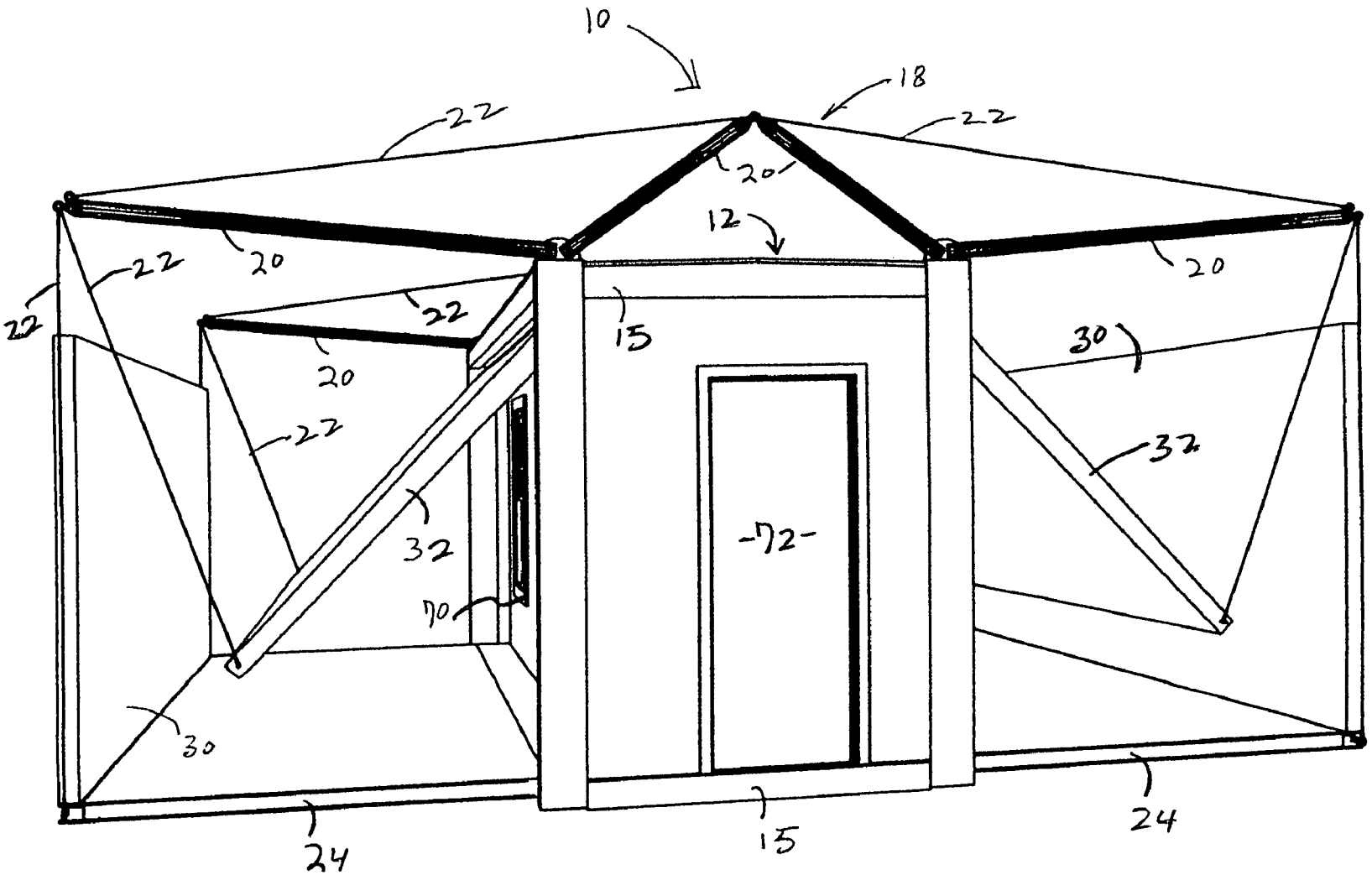
FIG. 7 is a perspective view of the embodiment of FIGS. 1 through 6 in yet another successive phase of assembly into the building unit configuration.
Figure 8:
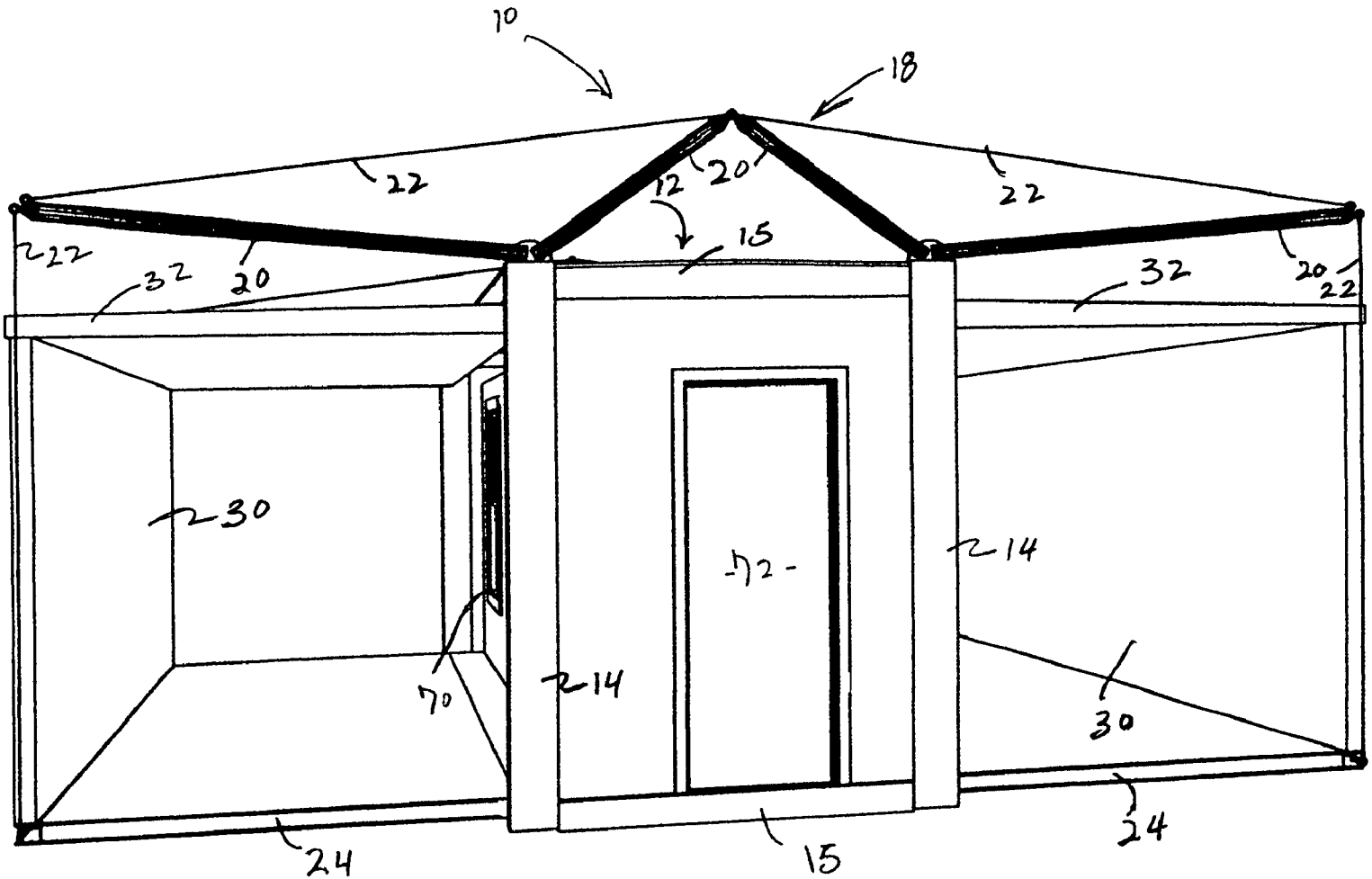
FIG. 8 is a perspective view of the embodiment of FIGS. 1 through 7 in yet another successive phase of assembly into the building unit configuration.

In addition, the modular assembly 10 includes a plurality of unit panels 32 initially represented in FIG. 7 and represented in their fully opened position in FIG. 8. As such, the first plurality of unit panels 32 may be unfolded outwardly from the frame 12, again through use of the erection assembly 18 including the associated cable(s) 22, as described above. A comparison of FIGS. 7 and 8 indicates the unfolding of the first plurality of unit panels 32 into their fully opened positions. As such, the first plurality of unit panels 32 at least partially define correspondingly disposed ceiling portions the building unit configuration, as the first plurality of frame panels 32 are disposed in overlying relation to the interior of the building unit configuration, when completely assembled.

Figure 9:
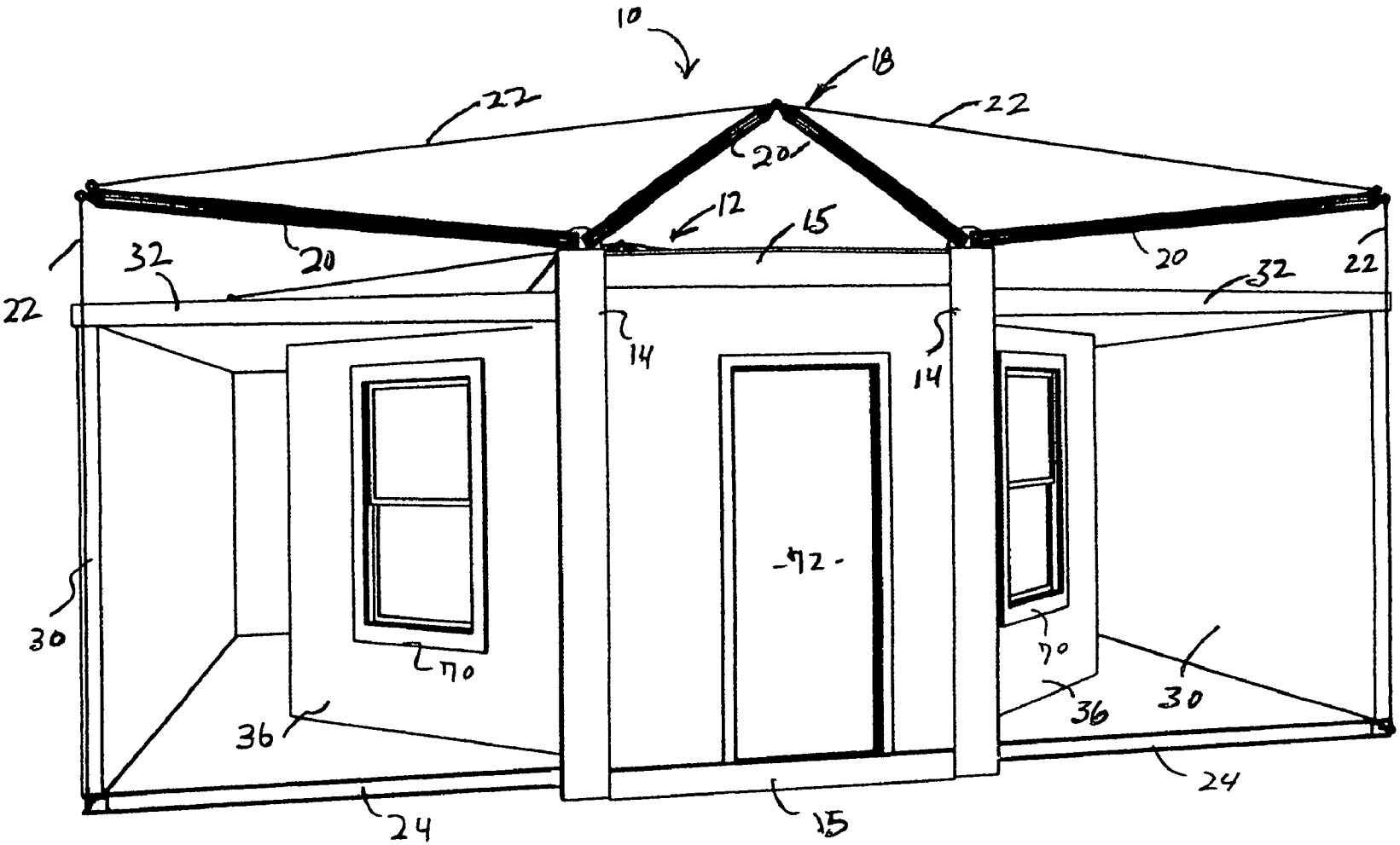
FIG. 9 is a perspective view of the embodiment of FIGS. 1 through 8 in yet another successive phase of assembly into the building unit configuration.
Figure 13:
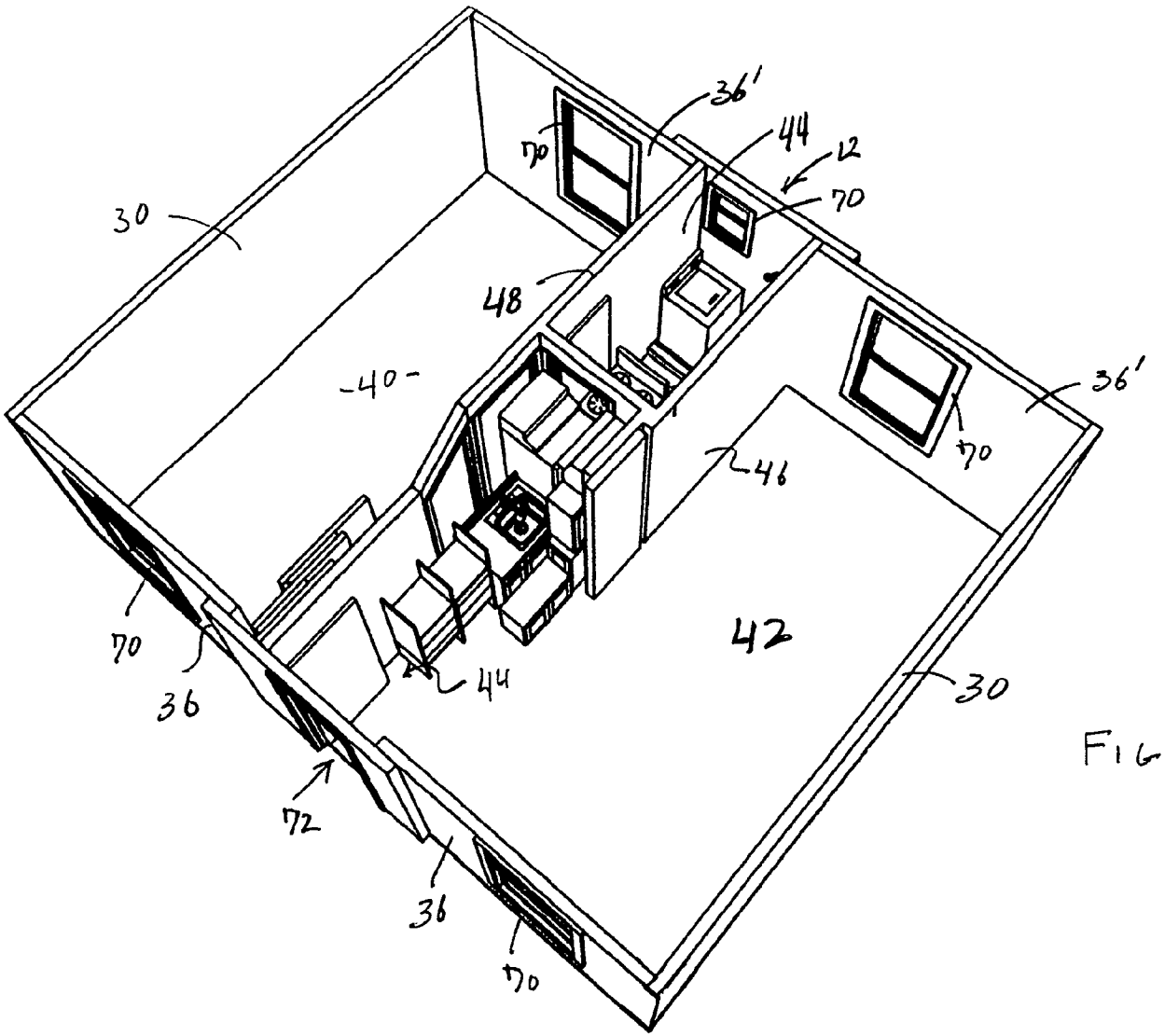
FIG. 13 is an overhead view of the interior of the modular assembly when in the building unit configuration.
Figure 14:
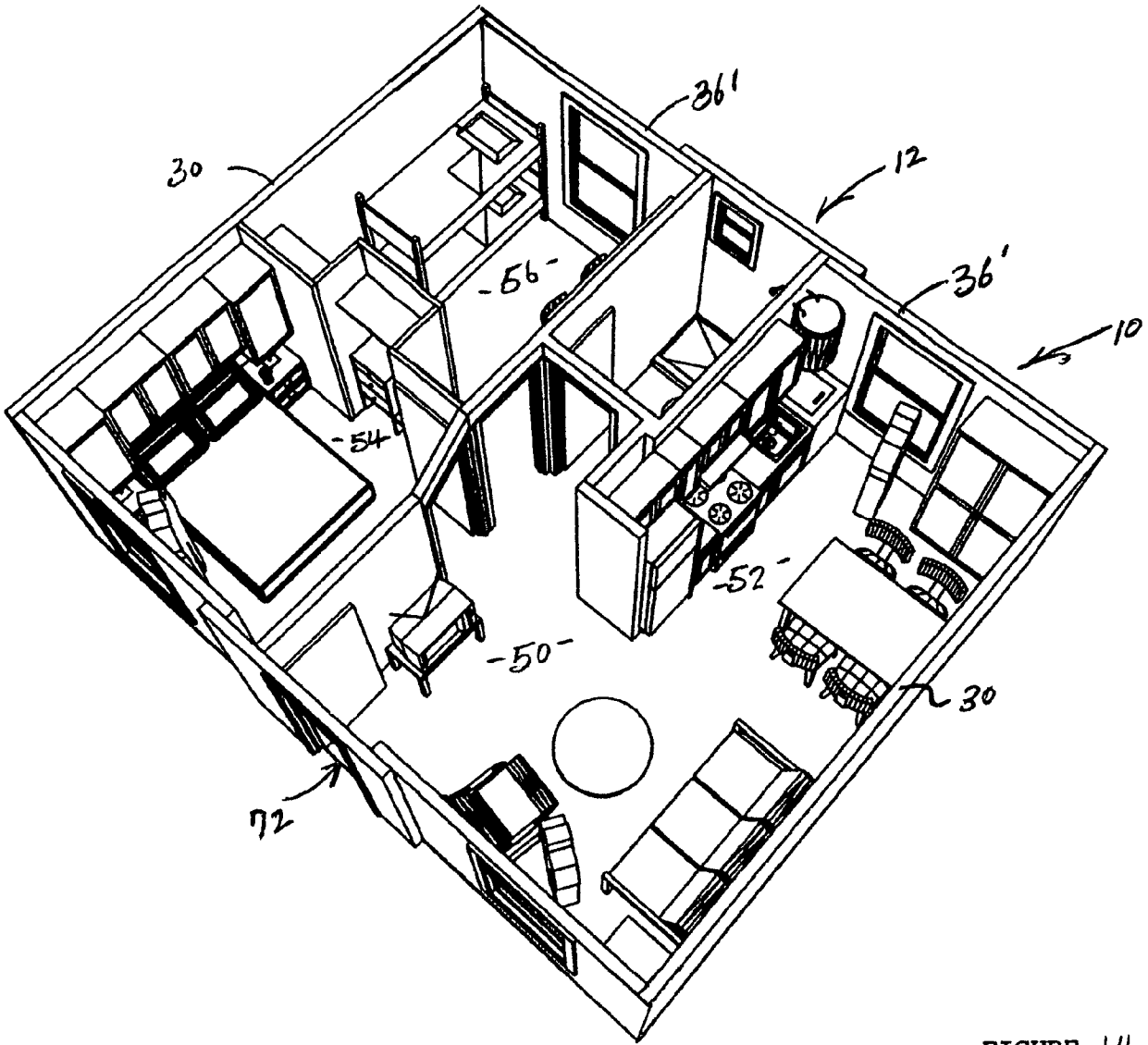
FIG. 14 is a perspective overhead view of one preferred embodiment of the interior of the modular assembly in building unit configuration with appliances, shelves, cabinets, closets, furnishings and partitions in place.

FIG. 9 represents an additional plurality or others of the plurality of unit panels 36 and 36' pivotally, hingedly or otherwise movable relative to the frame 12. As represented in the embodiment of FIGS. 9 through 12, the additional or second plurality of unit panels 36 are each disposed to be selectively oriented in their opened position as represented in FIGS. 11 and 12. When so opened, each of the plurality of unit panels 36 and 36' are disposed to respectively and at least partially define front and rear end wall panels of the building unit configuration. When fully assembled into the building unit configuration of FIGS. 10 and 11, the interior thereof is represented in FIGS. 13 and 14. The interior of the building unit configuration is preferably, but not exclusively, formed into a plurality of sections 40, 42 and 44 at least partially separated from one another. However, the sections 40, 42 and 44 are disposed in communicating, accessible relation with one another in order to allow occupants to pass easily between the various sections 40, 42 and 44. At least partially segregating the sections 40, 42 and 44 is a partition assembly 46 and 48, which effectively defines interior wall portions of the building unit configuration. The partitions or interior wall units 46 and 48 separate what may be referred to as a primary or main room 50 and kitchen or utility area 52 from separate, at least partially segregated bedrooms or other room areas 54 and 56. As also a bathroom area generally indicated as 60 may also be defined by the interior walls or partitions 46 and 48.

In addition to the above various appliances or utilities may be included in appropriate portions of the interior of the building unit configuration. Such additional appliances or facilities may include kitchen cabinets which can be affixed to the kitchen or other utility area 52 by means of tracks or like coupling or installation structures. In addition, water, sewer and electric utility connections as well as appropriate sinks, bathing facilities, stove or ranges, refrigerators, air conditioners, etc. may also be appropriately positioned on the interior of the building unit construction as generally represented in both FIGS. 11 and 12.

In addition appropriate windows 70, door(s) 72, doorways, halls or passageways (see FIGS. 13 and 14) are pre-structured and appropriately disposed in the various portions of the frame 12, partitions 46 and 48, panel segments 30 or unit panels defining the end walls as at 36.

FIGS. 15 through 20 represent yet another preferred embodiment of the modular assembly, generally indicated as 10'. It is to be noted that the individual components of the modular assembly 10' are substantially equivalent to that of the modular assembly 10 as represented in the preferred embodiments of FIGS. 1 through 14. However, the difference between the additional preferred embodiment of the modular assembly 10' is the relative disposition of the frame panels 24, panel segments 30 and unit panels 32, 36 and 36'. As such, the method of assembly or deployment of the various frame panels or unit panels differ in the embodiment of the modular assembly 10' from that of the modular assembly 10. Moreover, the initial configuration of the modular assembly 10 and 10', when in the shipping container orientation, is the same as represented in FIG. 1. Similarly when in the fully assembled building unit configuration the overall exterior and interior appearances of the modular assemblies 10 and 10' are substantially equivalent. As set forth above, it is acknowledged that the overall structural appearance and/or configuration when either the shipping unit orientation of FIG. 1 or the building unit orientation of FIGS. 1 through 14 may vary without departing from the intended spirit and scope from the present invention.

Figure 15:
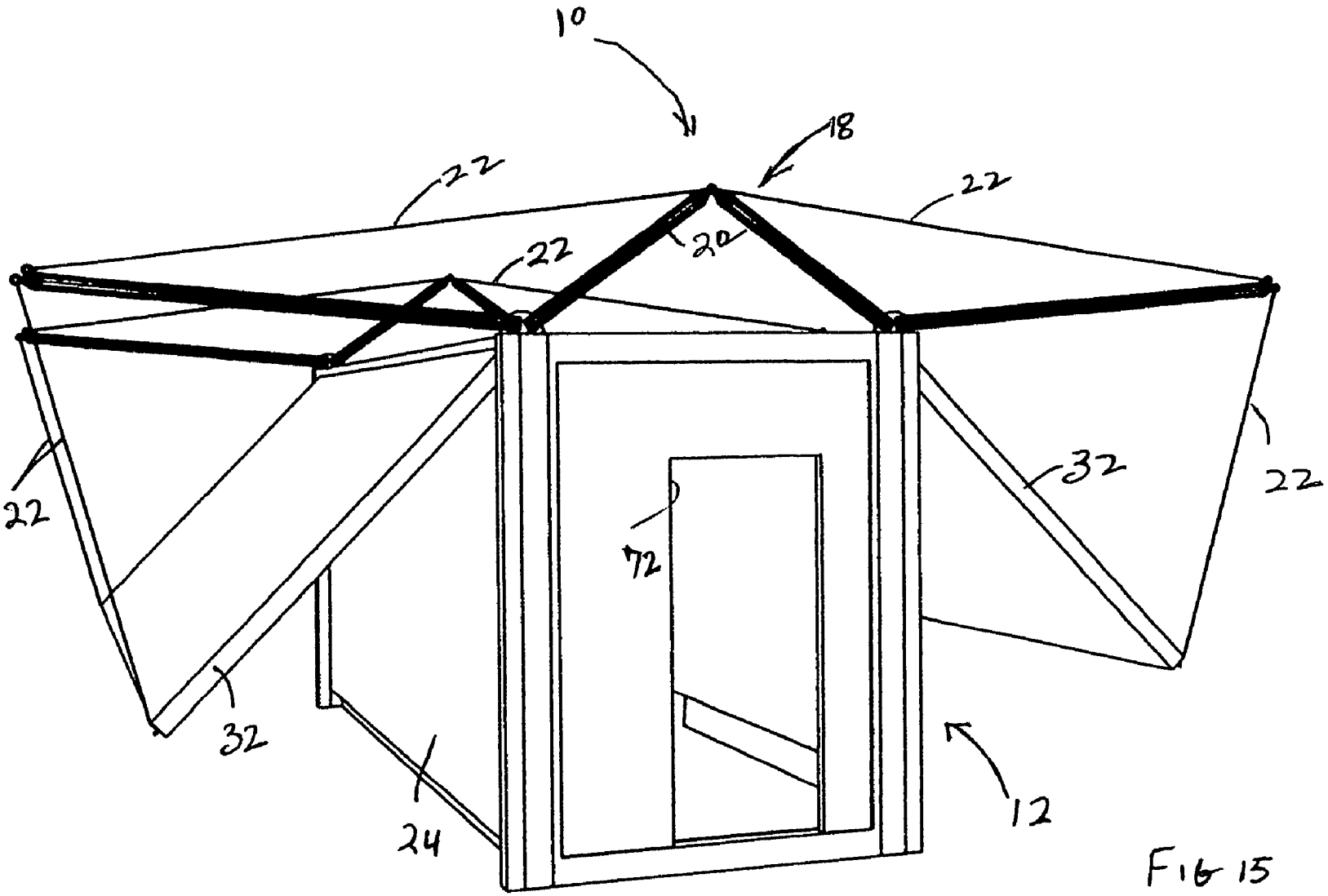
FIGS. 15-20 represent perspective views disclosing successive phases of assembly of another preferred embodiment of the modular assembly of the present invention from a shipping container configuration into a building unit configuration, which differ from the successive steps of assembly as represented in FIGS. 1-14.
Figure 16:
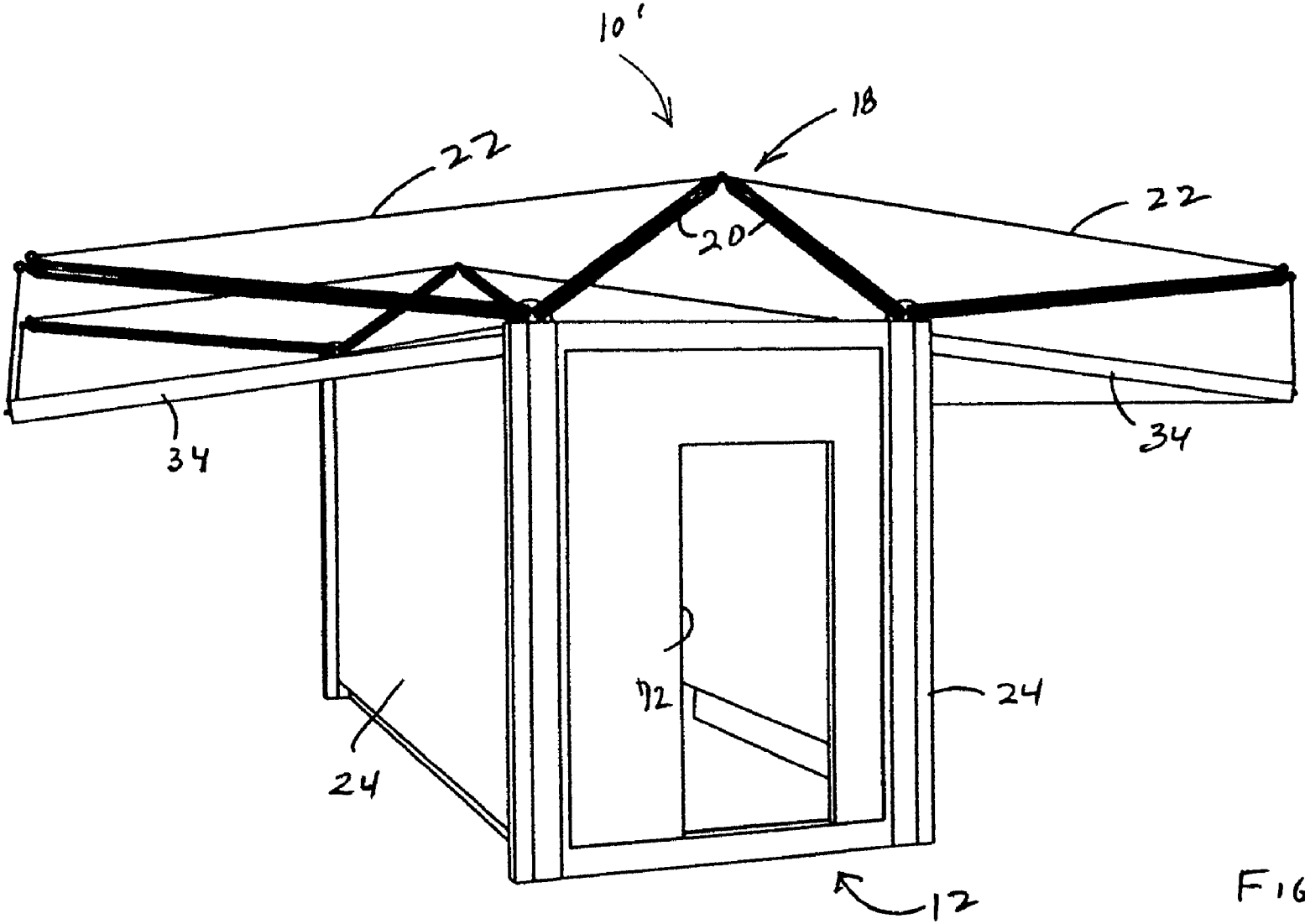
Figure 17:
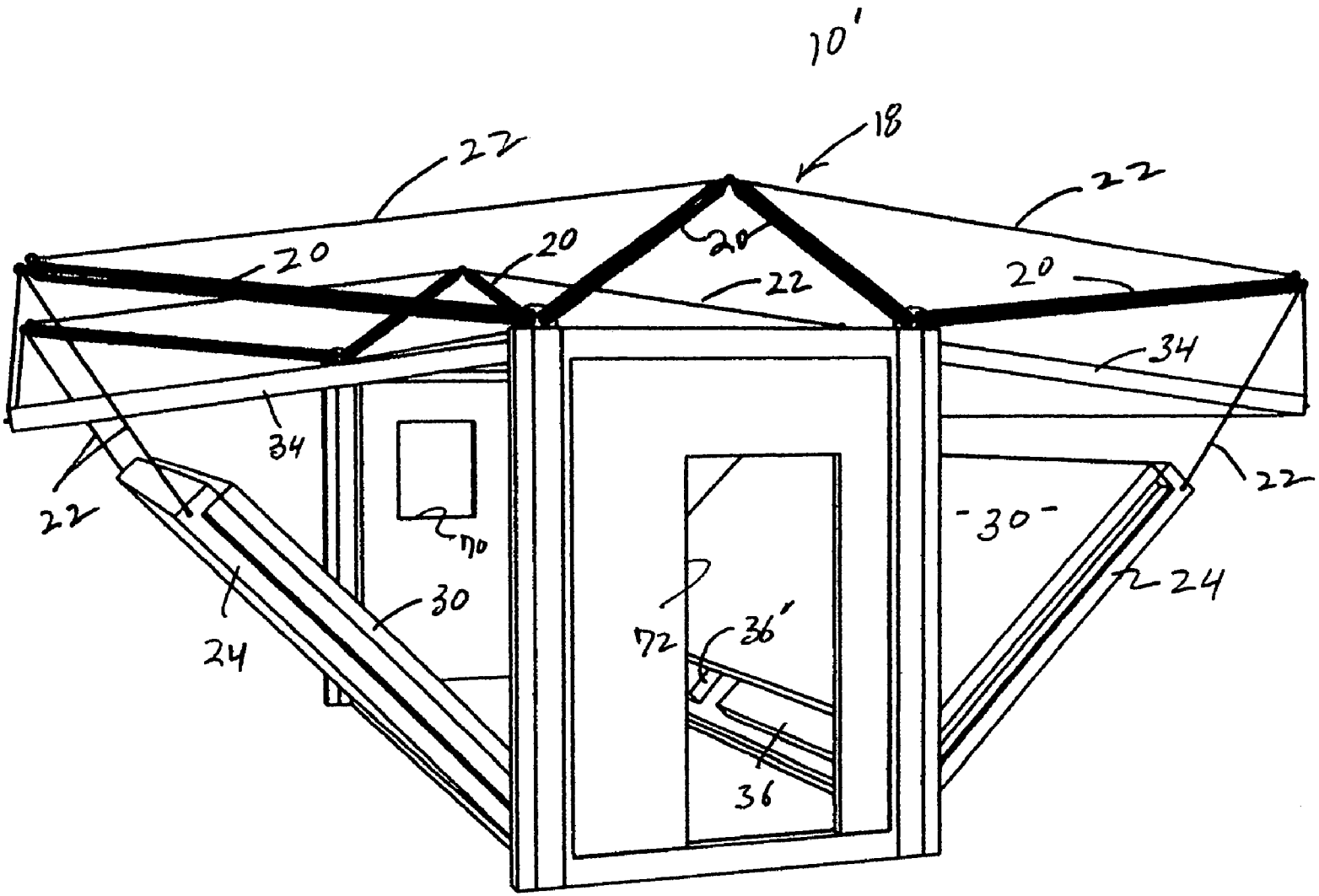
Figure 18:
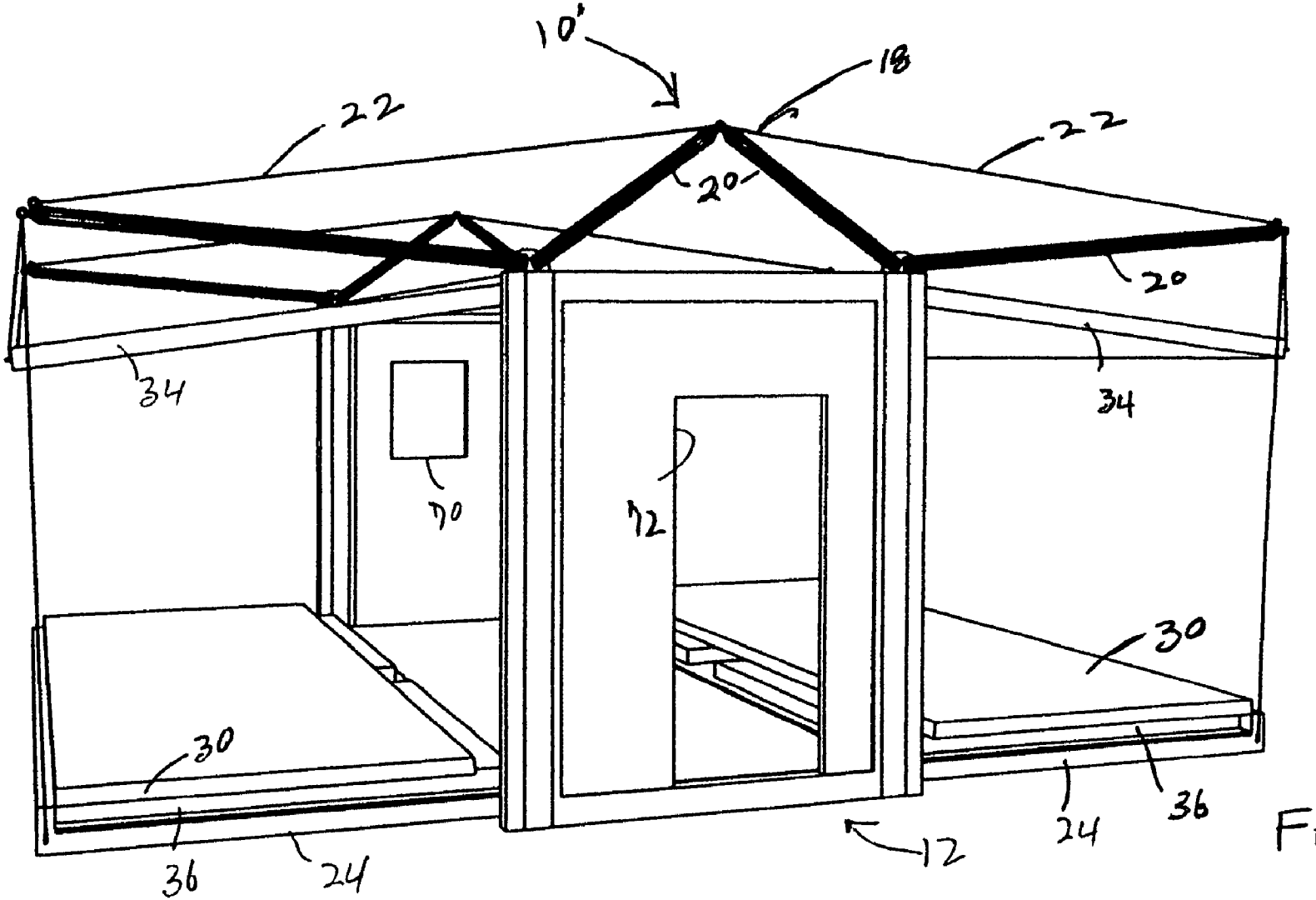

Accordingly, with primary reference to FIG. 15, the modular assembly 10' includes the aforementioned erection assembly 18 including a plurality of erection or boom members 20 movably and actively supporting a plurality of cable or cable segments 22 in order to position each or at least some of the frame panels and unit panels between their closed position and their opened position. Once the erection assembly 18 is properly disposed on the exterior of the frame 12 as described with reference to FIG. 1A, deployment or positioning of the various panels occurs by first pivotally opening of the unit panels 32 into their upwardly supported position. As such, the unit panels 32 of the modular assembly 10' define a ceiling or roof portion of the building unit configuration when completely assembled. With reference to FIGS. 17 and 18, once the unit panels 34 are in their at least partially raised or opened position, the frame panels 24 are next manipulated or disposed into their opened position so as to define the floor or foundation portions of the building unit configuration as represented in FIG. 18.

Figure 19:
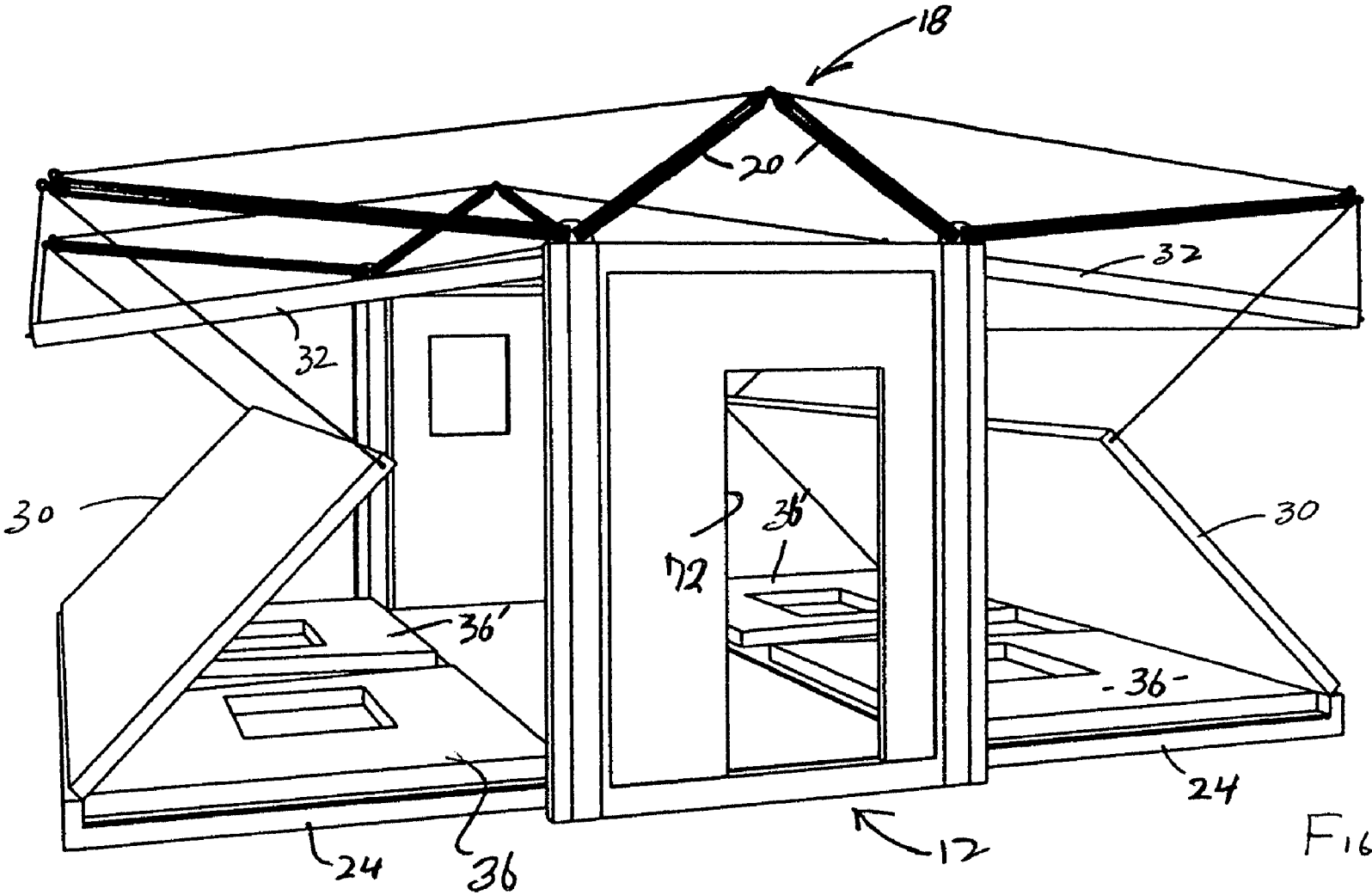
Figure 20:
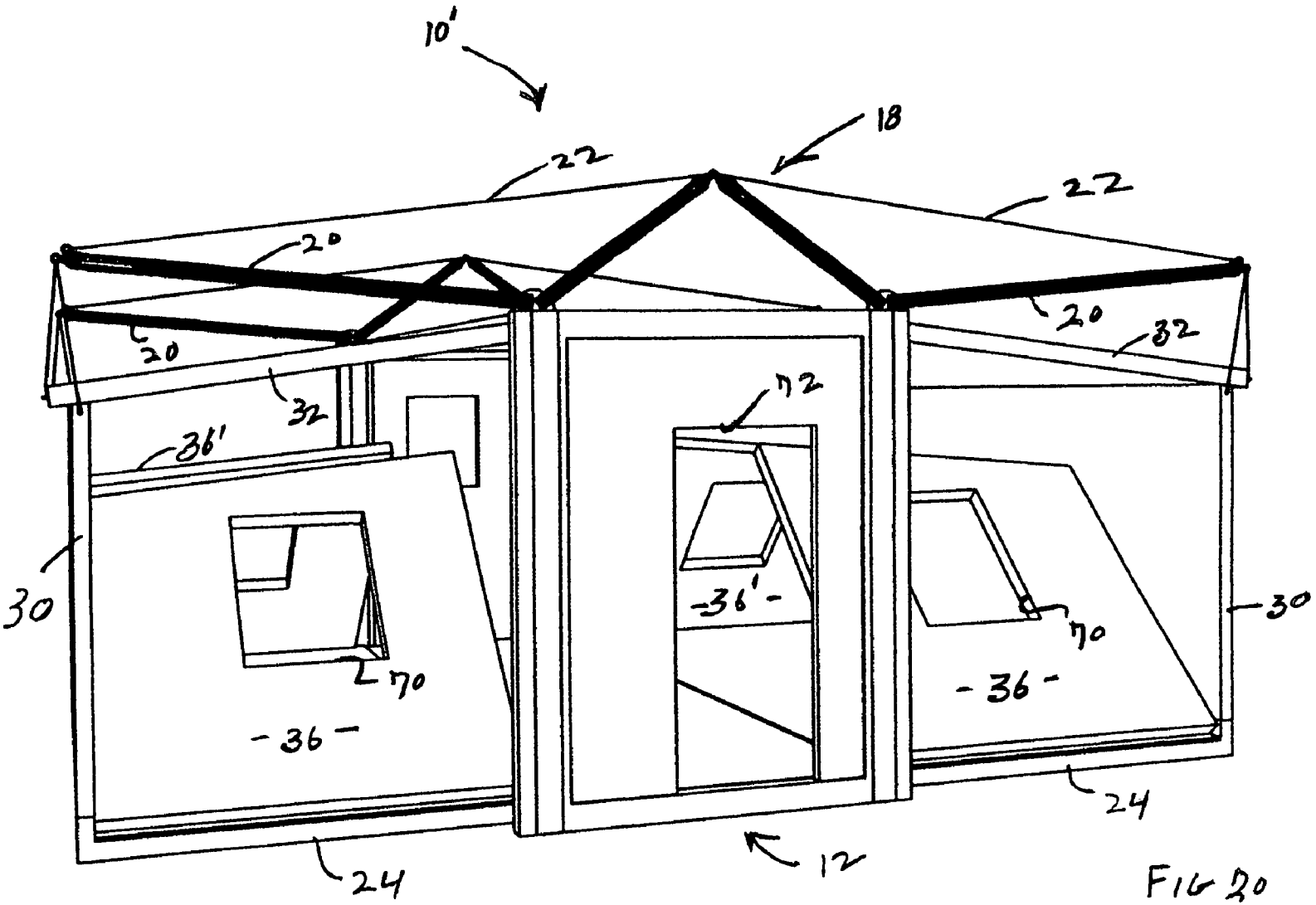

FIG. 19 further shows the operation of the erection assembly 18 so as to dispose the panel segments 30 into their opened position. As such, the panel segments 30 form the longer or long sidewall portions of the building unit orientation similar to that of the modular assembly 10. Additional similarities include each of the frame panels 24 preferably having the panel segments 30 pivotally or otherwise movably connected thereto. Such pivotal or other movable connection between the frame panels 24 and the panel segments 30 facilitate their outward, opened disposition so as to define the long sidewall portions of the building unit configuration as clearly represented in FIG. 20.

Thereafter, the other or additional plurality of unit panels 36 and 36' are next pivotally or otherwise movably disposed from their closed position, as represented in FIGS. 15 through 19, to their opened position. As such, the additional unit panels 36 and 36' respectively define the front end wall and rear end wall portions of the building unit configuration, as clearly represented in FIGS. 10 through 12.

Further, once the modular assembly 10' is in the fully assembled position, the erection assembly 18 is dissembled from the exterior, supported position on the frame 12 and is disposed in any convenient stored location, such as on the interior of the frame 12 adjacent to or at least partially within the corner portions 14, as set forth above.

As with the preferred embodiment of the modular assembly 10, a plurality of portal openings 70 and 72 defining windows, doors or like openings may be preformed or otherwise constructed in the front and rear end walls 36 and 36', the frame 12 and the long side wall portions of the building defined by the panel segments 30.

Because many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A modular assembly structured to assume either a box-shaped shipping container configuration or a building unit configuration, said modular assembly comprising:

a housing which defines the shipping container configuration and at least a portion of the building unit configuration;

a central frame comprising a plurality of vertical support members located at each corner of the housing, wherein the central frame defines an outside of the shipping container configuration;

a plurality of frame panels disposable in a substantially closed, interconnected position to at least partially define the outside of the shipping container configuration, said plurality of frame panels pivotably connected to a lower part of said central frame such that the plurality of frame panels are pivotably disposed outwardly from the lower part of said central frame into an opened position to at least partially define a floor portion of the building unit configuration;

a plurality of unit panels pivotably connected to an upper part of said central frame, and in a closed position are aligned with said frame panels being in said closed position, said plurality of unit panels pivotably disposable outwardly from the upper part of said frame into an opened position to further at least partially define a ceiling portion of the building unit configuration; and a plurality of erection assemblies provided for erecting the plurality of frame panels and the plurality of unit panels, wherein each of the frame panels and each of the unit panels is configured to be manipulated by a respective corresponding erection assembly of the plurality of erection assemblies, wherein all of the plurality of erection assemblies include a plurality of erection members collectively disposable in an assembling position exteriorly of the housing, the plurality of erection members of each of the plurality of erection assemblies are supported exteriorly above a corresponding vertical support member of the plurality of vertical support members and extend exteriorly therefrom in the assembling position, and each of the plurality of erection assemblies, including the plurality of erection members, when in the assembling position, being structured to facilitate disposition of at least one of said frame panels in the building unit configuration.

2. A modular assembly as recited in claim 1, wherein each of said plurality of frame panels includes at least one panel segment pivotably connected to a free edge of said frame panel and positionable outwardly there from to further at least partially define the building unit configuration; and wherein the at least one panel segment is configured to be manipulated by the respective corresponding erection assembly of the plurality of erection assemblies.

3. A modular assembly as recited in claim 2 wherein said plurality of frame panels are structured and positionable to define a floor portion of the building unit configuration.

4. A modular assembly as recited in claim 2 wherein said at least one panel segment is structured and positionable to a vertical position to define a vertical sidewall portion of the building unit configuration.

5. A modular assembly as recited in claim 1 wherein said plurality of frame panels each include at least one panel segment;

said plurality of frame panels and corresponding ones of said panel segments positioned outwardly from said central frame into an opened position to collectively and at least partially define the building unit configuration; and wherein the at least one panel segment is configured to be manipulated by the respective corresponding erection assembly of the plurality of erection assemblies.

6. A modular assembly as recited in claim 5 wherein each of said plurality of frame panels is structured and positioned to define a different floor portion of the building unit configuration.

7. A modular assembly as recited in claim 6 wherein each of said panel segments is structured and positionable to a vertical position to define a different vertical sidewall portion of the building unit configuration.

8. A modular assembly as recited in claim 7 wherein at least some of said plurality of unit panels are movably connected to said central frame and positionable outwardly there from into said opened position to define different ceiling portions of the building unit configuration.

9. A modular assembly as recited in claim 8 wherein at least others of said plurality of unit panels are movably connected to said central frame and positionable outwardly there from into said opened position to collectively define front and rear end wall portions of the building unit configuration.

10. A modular assembly as recited in claim 1 wherein at least some of said plurality of unit panels are movably connected to said central frame and positionable outwardly there from into said opened position to define different ceiling portions of the building unit configuration.

11. A modular assembly as recited in claim 10 wherein others of said plurality of unit panels are movably connected to said central frame and positionable outwardly there from into said opened position to collectively define front and rear end wall portions of the building unit configuration.

12. A modular assembly as recited in claim 1 wherein said plurality of vertical support members are fixedly interconnected to define said central frame as a portion of both the shipping container configuration and the building unit configuration.

13. A modular assembly as recited in claim 1, wherein each of the frame panels and each of the unit panels is configured to be manipulated by one of two respective corresponding pairs of erection assemblies of the plurality of erection assemblies.

14. A modular assembly as recited in claim 1, wherein each of the plurality of vertical support members includes a hollow cavity, and the plurality of erection members of each of the plurality of erection assemblies are configured to be disposed in a stored position within the hollow cavity of the corresponding vertical support member.

15. A modular assembly as recited in claim 1, wherein the plurality of erection assemblies, when in said assembling position, being structured to facilitate disposition of said frame panels and said unit panels in either the shipping container configuration or the building unit configuration, such that each of said frame panels and each of said unit panels are configured to be manipulated between the shipping container configuration and the building unit configuration.

16. A modular assembly structured to assume either a box-shaped shipping container configuration or a building unit configuration, said modular assembly comprising:

a central frame comprising a plurality of vertical support members that defines an outside of the shipping container configuration, a plurality of frame panels pivotably connected to a lower part of said central frame such that the plurality of frame panels are disposable in either a closed position or an opened position, said closed position of said frame panels at least partially defining the outside of the shipping container configuration and said opened position at least partially defining the building unit configuration, said plurality of frame panels pivotably disposed outwardly from the lower part of said central frame when in said opened position to collectively define floor portions of the building unit configuration, a plurality of unit panels pivotably connected to an upper part of said central frame such that said plurality of unit panels are pivotably disposable outwardly from the upper part of said central frame and collectively defining ceiling portions of the building unit configuration, and a plurality of erection assemblies disposable in an assembling position on an exterior of the central frame;

said plurality of erection assemblies disposed and structured to facilitate disposition of at least some of the frame panels in said opened position to define the building unit configuration; and said plurality of erection assemblies each comprising a plurality of erection members provided for erecting the plurality of frame panels and the plurality of unit panels, wherein each of the frame panels and each of the unit panels is configured to be manipulated by one of two respective corresponding pairs of erection assemblies of the plurality of erection assemblies;

wherein each of the plurality of vertical support members includes a hollow cavity, and the erection members of each of the plurality of erection assemblies are configured to be disposed in a stored position within the hollow cavity of the corresponding vertical support member.

17. A method of making a building unit configuration, comprising:

providing the modular assembly structure of claim 1, and using the plurality of erection assemblies to erect the plurality of frame panels and the plurality of unit panels, comprising:

manipulating each of said frame panels and each of said unit panels from the shipping container configuration to the building unit configuration using the plurality of erection assemblies and a plurality of cable and pulley assemblies cooperatively connected to the plurality of erection assemblies.

18. A method of making a building unit configuration, comprising:

providing the modular assembly structure of claim 16, and using the plurality of erection assemblies to erect the plurality of frame panels and the plurality of unit panels, comprising:

manipulating each of said frame panels and each of said unit panels from the shipping container configuration to the building unit configuration using the plurality of erection assemblies and a plurality of cable and pulley assemblies cooperatively connected to the plurality of erection assemblies.

19. A modular assembly as recited in claim 1, wherein each of said frame panels and each of said unit panels is configured to be manipulated between the shipping container configuration and the building unit configuration.

20. A modular assembly as recited in claim 1, wherein the plurality of erection members of each of the plurality of erection assemblies, when in said assembling position, are structured to facilitate disposition of said frame panels and said unit panels in either the shipping container configuration or the building unit configuration, and when in the assembling position, the plurality of erection members of each of the plurality of erection assemblies are disposed entirely outside of the housing.

21. A modular assembly structured to assume either a shipping container configuration or a building unit configuration, said modular assembly comprising:

a housing which defines the shipping container configuration and at least a portion of the building unit configuration;

a frame comprising a plurality of vertical support members located at each corner of the housing;

a plurality of frame panels disposable in a substantially closed, interconnected position to at least partially define the shipping container configuration, at least one of said plurality of frame panels moveably disposed outwardly from said frame into an opened position to at least partially define the building unit configuration;

a plurality of unit panels movably connected to and disposable on said frame in a closed position aligned with said frame panels being in said closed position, said plurality of unit panels movably disposable outwardly from said frame into fan opened position to further at least partially define the building unit configuration; and a plurality of erection assemblies provided for erecting the plurality of frame panels and the plurality of unit panels, wherein each of the frame panels and each of the unit panels is configured to be manipulated by a respective corresponding erection assembly of the plurality of erection assemblies, wherein each of the plurality of erection assemblies includes a plurality of erection members collectively disposable in an assembling position exteriorly of the housing, the plurality of erection members of each of the plurality of erection assemblies are supported exteriorly above a corresponding vertical support member of the plurality of vertical support members and extend exteriorly therefrom in the assembling position, each of the plurality of erection assemblies, including the plurality of erection members, when in the assembling position, being structured to facilitate disposition of at least one of said frame panels in the building unit configuration, and the plurality of erection members of each of the plurality of erection assemblies comprise a first erection rod, which extends outwardly away from the housing such that an end of the first erection rod is not disposed over the housing, and a second erection rod, which extends inwardly over the housing such that an end of the second erection rod is disposed over the housing, when in the assembling position;

wherein each of the plurality of vertical support members includes a hollow cavity, and the first erection rod and the second erection rod of each of the plurality of erection assemblies are configured to be disposed in a stored position within the hollow cavity of the corresponding vertical support member.

22. A modular assembly as recited in claim 21, wherein the end of the second erection rod of erection members meets with the end of the second erection rod of another one of the plurality of erection members over the housing.

23. A modular assembly as recited in claim 21, further comprising a cable and pulley assembly cooperatively connected to the plurality of erection members of each of the plurality of erection assemblies, and removably connected to each of the frame panels and to each of the unit panels, to facilitate disposition of the frame panels and the unit panels between the shipping container configuration and the building unit configuration.

24. A modular assembly as recited in claim 23, wherein the end of the first erection rod of each of the plurality of erection assemblies is removably connected to a longitudinal side of at least one of the frame panels and the unit panels by a cable of the cable and pulley assembly.

25. A modular assembly as recited in claim 1, further comprising a cable and pulley assembly cooperatively connected to the plurality of erection assemblies, and removably connected to each of the frame panels and to each of the unit panels, to facilitate disposition of the frame panels and the unit panels between the shipping container configuration and the building unit configuration.

26. A modular assembly as recited in claim 2, wherein the respective corresponding erection assembly is configured to manipulate the at least one panel segment between the shipping container configuration and the building unit configuration, wherein when in the shipping container configuration, a surface of said at least one of said plurality of frame panels abuts a surface of the at least one panel segment, and when in the building unit configuration, the at least one panel segment is structured and positionable to a vertical position to define a vertical sidewall portion of the building unit configuration.

27. The method as recited in claim 17, the manipulating each of said frame panels and each of said unit panels comprising:

deploying a first frame panel and a second frame panel of the plurality of frame panels from the shipping unit configuration by lowering a free end of the first frame panel and a free end of the second frame panel until each free end of the first and the second frame panels reaches a horizontal position defining the floor portion of the building unit configuration; and deploying a first unit panel and a second unit panel of the plurality of unit panels from the shipping unit configuration by raising a free end of the first unit panel and a free end of the second unit panel until each free end of the first and second unit panels reaches a horizontal position defining the ceiling portion of the building unit configuration, wherein the first frame panel, the second frame panel, the first unit panel and the second unit panel are each deployed using the plurality of erection assemblies, wherein during the lowering the free end of the first frame panel and the free end of the second frame panel, the free end of the first frame panel and the free end of the second frame panel are pivoted outward and away from the frame, and during the raising the free end of the first unit panel and a free end of the second unit panel until, the free end of the first unit panel and the free end of the second unit panel are pivoted outward and away from the frame.

28. The method as recited in claim 27, the method further comprising using the plurality of erection assemblies to erect a first panel segment movably connected to the first frame panel and positionable outwardly therefrom to further at least partially define the building unit configuration, and to erect a second panel segment movably connected to the second frame panel and positionable outwardly therefrom to further at least partially define the building unit configuration.

29. The method as recited in claim 28, the using the plurality of erection assemblies to erect the first panel segment and the second panel segment, comprising:

manipulating the first panel segment and the second panel segment from the shipping container configuration to the building unit configuration using the plurality of erection assemblies and the plurality of cable and pulley assemblies cooperatively connected to the plurality of erection assemblies, the manipulating the first panel segment and the second panel segment, comprising:

deploying the first panel segment and the second panel segment by raising a free end of the first panel segment and a free end of the second panel segment until each free end of the first and the second panel segments reaches a vertical position defining a vertical sidewall portion of the building unit configuration.

30. The method as recited in claim 28, the method further comprising deploying a plurality of front wall unit panels and a plurality of rear wall panels, each of the plurality of front wall unit panels and the plurality of rear wall panels movably connected to the central frame and positionable outwardly therefrom into an opened position to collectively define front and rear end wall portions of the building unit configuration.

31. The method as recited in claim 28, the method further comprising:

deploying a first front wall unit panel and a first rear wall unit panel, each of the first front wall unit panel and the first rear wall unit panel movably connected to opposite sides of the first frame panel and positionable outwardly therefrom into an opened position to collectively define front and rear end wall portions of the building unit configuration; and deploying a second front wall unit panel and a second rear wall unit panel, each of the second front wall unit panel and the second rear wall unit panel movably connected to opposite sides of the second frame panel and positionable outwardly therefrom into an opened position to collectively define the front and the rear end wall portions of the building unit configuration.

* * * * *